US010308031B2

(12) United States Patent
Kudo et al.

(10) Patent No.: US 10,308,031 B2
(45) Date of Patent: Jun. 4, 2019

(54) TANK, TANK UNIT, AND LIQUID EJECTION SYSTEM

(71) Applicant: SEIKO EPSON CORPORATION, Tokyo (JP)

(72) Inventors: Shoma Kudo, Shiojiri (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/556,968

(22) PCT Filed: Feb. 3, 2016

(86) PCT No.: PCT/JP2016/000537

§ 371 (c)(1),
(2) Date: Sep. 8, 2017

(87) PCT Pub. No.: WO2016/143247

PCT Pub. Date: Sep. 15, 2016

(65) Prior Publication Data

US 2018/0244056 A1 Aug. 30, 2018

(30) Foreign Application Priority Data

Mar. 12, 2015 (JP) ..... 2015-049473

(51) Int. Cl.
*B41J 2/175* (2006.01)

(52) U.S. Cl.
CPC ..... *B41J 2/17513* (2013.01); *B41J 2/175* (2013.01); *B41J 2/17553* (2013.01); *B41J 2/17556* (2013.01)

(58) Field of Classification Search
CPC . B41J 2/17513; B41J 2/17553; B41J 2/17556
See application file for complete search history.

(56) References Cited

U.S. PATENT DOCUMENTS

| | | | | |
|---|---|---|---|---|
| 8,926,073 | B2 | 1/2015 | Shimizu et al. | |
| 2014/0098166 | A1 | 4/2014 | Suzuki et al. | |
| 2016/0009100 | A1* | 1/2016 | Kudo | B41J 2/17553 347/92 |

FOREIGN PATENT DOCUMENTS

| | | | |
|---|---|---|---|
| JP | 2012-020495 | A | 2/2012 |
| JP | 2012-176587 | A | 9/2012 |
| JP | 2014-034191 | A | 2/2014 |

(Continued)

OTHER PUBLICATIONS

International Search Report dated Apr. 12, 2016 in PCT/JP2016/000537 with English-language translation (4 pgs.).

*Primary Examiner* — Jason S Uhlenhake
(74) *Attorney, Agent, or Firm* — Foley & Lardner LLP

(57) ABSTRACT

A technique is provided that can suppress leakage of a liquid from a tank. When an ink tank is in a reference orientation in which ink is injected into the ink tank, an atmospheric air introducing inlet of an atmospheric air communication path is located on an upper end side of the ink containing portion. Also, when the ink tank is in the reference orientation, when the ink tank is in a second orientation in which the ink tank has been rotated by 90° from the reference orientation, and when the ink tank is in a third orientation in which the ink tank has been rotated by 180°, at least a portion of the atmospheric air communication path is located at a height position of an upper end portion of the ink containing portion.

16 Claims, 18 Drawing Sheets

(56) References Cited

FOREIGN PATENT DOCUMENTS

| | | | |
|---|---|---|---|
| JP | 2014-058086 | A | 4/2014 |
| JP | 2014-184594 | A | 10/2014 |
| WO | WO-2014/132634 | A1 | 9/2014 |

* cited by examiner

FIG. 5A 0°
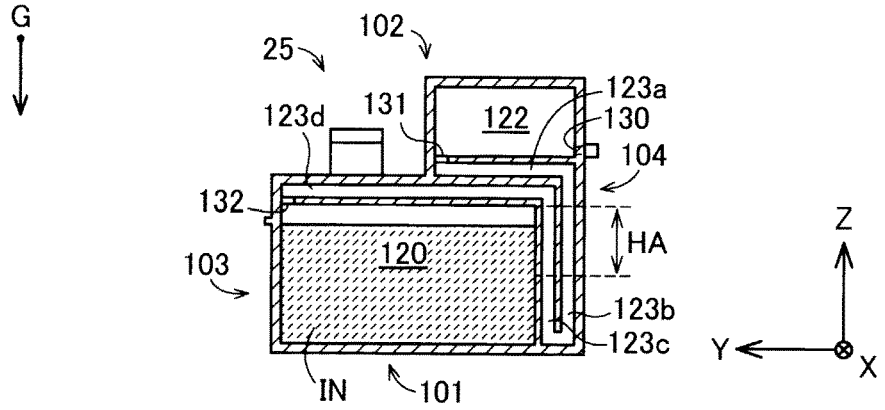
FIG. 5B 90°
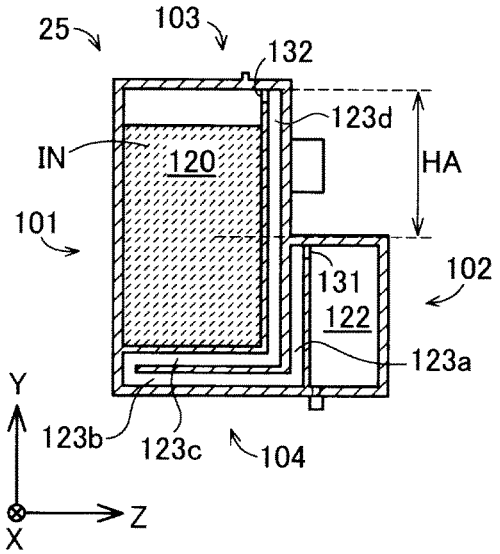
FIG. 5C 90°
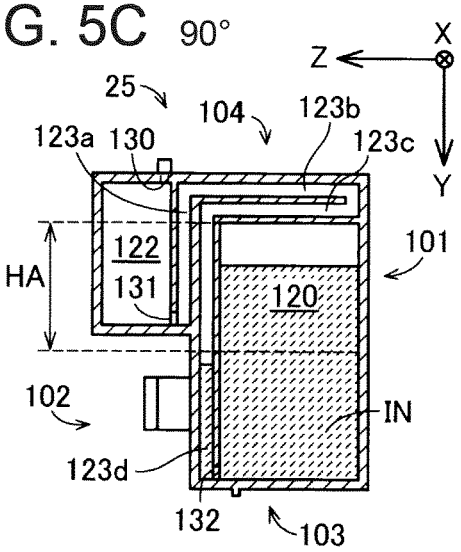
FIG. 5D 180°
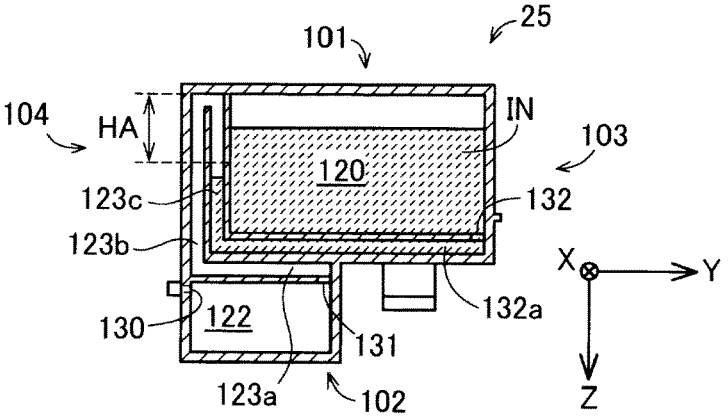

TANK, TANK UNIT, AND LIQUID EJECTION SYSTEM

CROSS-REFERENCE TO RELATED APPLICATIONS

The present application is a National Stage of International Application No. PCT/JP2016/000537, filed Feb. 3, 2016; which claims priority from Japanese Patent Application No. 2015-049473 filed on Mar. 12, 2015, the contents of both of which are hereby incorporated by reference into this application.

TECHNICAL FIELD

The present invention relates to a tank, a tank unit, and a liquid ejection system.

BACKGROUND ART

As a type of liquid ejection system, an inkjet printer (hereinafter also referred to simply as "printer") is known that forms an image by discharging ink onto print paper. Some printers include an ink tank that is attached thereto and into which ink can be injected via an injection inlet (for example, Patent Literatures 1 and 2 listed below, and the like).

CITATION LIST

Patent Literature

Patent Literature 1 JP-A-2012-20495
Patent Literature 2 JP-A-2014-184594

SUMMARY OF INVENTION

Technical Problem

Usually, an ink tank is provided with an atmospheric air communication path for introducing atmospheric air into the ink tank as ink is consumed. The ink tank is problematic in that the ink contained in the ink tank may leak out through the atmospheric air communication path when the ink tank is set in an orientation different from an ordinarily expected orientation, or when the ink tank is installed in an ordinarily expected environment, or the like.

Solution to Problem

The present invention has been made to solve the above-described problem encountered not only with an ink tank but also at least a tank that can contain a liquid that is supplied to a liquid ejection head, and the invention can be implemented in the following implementations.

Advantageous Effects of Invention

[1] A first implementation according to the present invention provides a tank. The tank is capable of supplying a liquid to a liquid ejection head, and may include a liquid containing portion, a liquid injection portion, and an atmospheric air introducing portion. The liquid containing portion may be configured so as to be capable of containing the liquid. The liquid injection portion may be configured such that the liquid can be injected into the liquid containing portion therethrough. The atmospheric air introducing portion may be configured such that atmospheric air can be introduced into the liquid containing portion therethrough. The atmospheric air introducing portion may include a buffer chamber that is capable of containing atmospheric air and an atmospheric air communication path that communicates between the buffer chamber and the liquid containing portion. The atmospheric air communication path may include an atmospheric air introducing inlet in an area where the atmospheric air communication path intersects with the liquid containing portion. The buffer chamber may be provided with a first communication inlet that is connected to the atmospheric air communication path and a second communication inlet through which external atmospheric air can be introduced into the buffer chamber. When the tank is in a first orientation in which the liquid is injected into the liquid containing portion via the liquid injection portion, the atmospheric air introducing inlet may be located on an upper end side of the liquid containing portion. The atmospheric air communication path may have: (i) a first portion that is located in a height position between an upper end portion of the liquid containing portion and a midpoint between the upper end portion of the liquid containing portion and a lower end portion of the liquid containing portion when the tank is in the first orientation; (ii) a second portion that is located in a height position between an upper end portion of the liquid containing portion and a midpoint between the upper end portion of the liquid containing portion and a lower end portion of the liquid containing portion when the tank is in a second orientation in which the tank has been rotated by 90° in a predetermined direction from the first orientation; and (iii) a third portion that is located in a height position between an upper end portion of the liquid containing portion and a midpoint between the upper end portion of the liquid containing portion and a lower end portion of the liquid containing portion when the tank is in a third orientation in which the tank has been rotated by 180° in the predetermined direction from the first orientation. The second communication inlet may be located above a lower end portion of the buffer chamber when the tank is in the second orientation and in which the atmospheric air introducing inlet is located on a lower end side, and when the tank is in the third orientation. With the tank according to this implementation, even when the orientation of the tank is rotated from the first orientation, it is possible to suppress a situation in which the liquid reaches the buffer chamber via the atmospheric air communication path. Also, even if the liquid reaches the buffer chamber, the liquid can be stored in the buffer chamber, and it is therefore possible to suppress a situation in which the liquid leaks to the outside via the second communication inlet. Accordingly, the occurrence of leakage of the liquid from the tank is suppressed.

[2] In the tank according to the implementation described above, the atmospheric air communication path may include a first path portion, a second path portion, a third path portion, and a fourth path portion, and when the tank is in the first orientation, the first path portion may extend on an upper side or a lower side of the buffer chamber, the second path portion may extend downward from the first path portion, the third path portion may extend upward from a lower end of the second path portion, and the fourth path portion may extend in a direction that intersects with an up-down direction of the tank from an upper end of the third path portion on the upper end side of the liquid containing portion. With the tank according to this implementation, a situation is suppressed in which the liquid passes through each path portion of the atmospheric air communication path and reaches the buffer chamber.

[3] The tank according to the implementation described above may include a reference amount specifying portion that specifies an amount of the liquid contained in the liquid containing portion to a predetermined reference amount, and a relationship represented by the following expression may be satisfied: $Va\times\alpha-Vb<V<Va\times\alpha$, where V represents a capacity of the buffer chamber, Va represents a difference between a capacity of the liquid containing portion and a volume of the liquid in the reference amount at room temperature, Vb represents a capacity of the atmospheric air communication path, and $\alpha$ is a predetermined coefficient of 1 or less. With the tank according to this implementation, when the tank is in a state in which the atmospheric air introducing inlet is located on a lower side and the liquid containing portion is filled with the liquid, even if the liquid is forced out into the atmospheric air introducing portion due to air in the liquid containing portion expanding, the forced-out liquid can be stored in the buffer chamber. Also, the buffer chamber is prevented from being made to be larger more than necessary.

[4] In the tank according to the implementation described above, the predetermined coefficient $\alpha$ may be a value to which an air expansion coefficient is reflected. With the tank according to this implementation, leakage of the liquid caused by the expansion of the air in the liquid containing portion is more reliably suppressed.

[5] In the tank according to the implementation described above, the atmospheric air communication path may include an intermediate buffer portion, the intermediate buffer portion may include a first opening that is in communication with the liquid containing portion side and a second opening that is in communication with the buffer chamber side, and when the tank is in the third orientation, the first opening and the second opening may be located above a lower end of the intermediate buffer portion. With the tank according to this implementation, even when the tank is brought into the third orientation, the liquid can be stored in the intermediate buffer portion, and thus leakage of the liquid when the tank is in the third orientation is further suppressed.

[6] In the tank according to the implementation described above, the atmospheric air communication path may be a first atmospheric air communication path, and the tank may further include a second atmospheric air communication path that is connected to the second communication inlet. With the tank according to this implementation, the liquid can also be stored in the second atmospheric air communication path provided downstream of the buffer chamber, and thus leakage of the liquid is further suppressed.

[7] In the tank according to the implementation described above, the buffer chamber may be a first buffer chamber, and the second atmospheric air communication path may include a second buffer chamber that is capable of containing atmospheric air to be introduced into the first buffer chamber. With the tank according to this implementation, the liquid is stored in the second buffer chamber as well in addition to the first buffer chamber, and thus leakage of the liquid is further suppressed.

[8] In the tank according to the implementation described above, the first orientation may be an orientation in which the liquid is supplied from the tank to the liquid ejection head, and when the tank is in the first orientation, the first communication inlet may be located in a lower end of the buffer chamber. With the tank according to this implementation, the liquid that has flowed into the buffer chamber is guided in a direction back toward the liquid containing portion along with the liquid being supplied to the liquid ejection head, and thus leakage of the liquid is further suppressed.

[9] The tank according to the implementation described above may include a case member that is a box having an opening in one direction; and a sheet member that is bonded so as to be capable of sealing the opening of the case member, and the liquid containing portion and the atmospheric air introducing portion may be formed between the case member and the sheet member, and each of the first orientation, the second orientation, and the third orientation may be an orientation in which a direction of the opening of the case member is perpendicular to a vertical direction. With the tank according to this implementation, it is possible to achieve simplification of the configuration, weight reduction, and cost reduction of the tank and facilitation of production.

[10] A second implementation according to the present invention provides a tank unit. The tank unit according to this implementation may include a first tank, a second tank, and an outer jacket. The first tank and the second tank may be the tanks according to the above-described implementation. The outer jacket may be capable of housing the first tank and the second tank. The first tank and the second tank may have different widths in the direction of the opening of the case member such that the liquid containing portions of the first tank and the second tank have different capacities. The first tank and the second tank may be the tank according to the implementation described above. With this tank unit, leakage of the liquid from each tank is suppressed. Also, a plurality of types of tanks having different capacities are provided, and it is therefore possible to enhance the adaptability for the pattern of consumption of the liquid in the liquid ejection system.

[11] A third implementation according to the present invention provides a tank unit. The tank unit according to this implementation may include a tank and an outer jacket. The tank may be the tank according to the above-described implementation. The outer jacket may be capable of housing the tank. With this tank unit, the occurrence of leakage of the liquid from the tank is suppressed.

[12] A fourth implementation according to the present invention provides a liquid ejection system. The liquid ejection system according to this implementation may include a tank unit and a liquid ejection apparatus. The tank unit may be the tank unit according to the above-described implementation. The liquid ejection apparatus may include the liquid ejection head, and the tank unit may be connected to the liquid ejection apparatus. With the liquid ejection system according to this implementation, the occurrence of leakage of the liquid from the tank is suppressed. In addition, the liquid ejection apparatus and the tank unit are configured as separate bodies, and it is therefore possible to enhance the ease of maintenance of the liquid ejection apparatus and the tank unit.

[13] A fifth implementation according to the present invention provides a liquid ejection system. The liquid ejection system according to this implementation may include a tank, a liquid ejection head, and an outer jacket. The tank may be the tank according to the above-described implementation. The outer jacket may be capable of housing the tank and the liquid ejection head. With the liquid ejection system according to this implementation, the occurrence of leakage of the liquid from the tank is suppressed. Also, because the liquid ejection head and the tank are integrated, the installation efficiency of the liquid ejection system is enhanced.

Note that not all of a plurality of constituent elements of each implementation of the present invention are essential, and in order to solve some or all of the above-described problems or achieve some or all of the effects described in the specification, some of the plurality of constituent elements may be changed, removed or replaced with additional other constituent elements as appropriate, or some of the limitations may be partially removed as appropriate. Also, in order to solve some or all of the above-described problems or achieve some or all of the effects described in the specification, it is also possible to combine some or all of the technical features included in one implementation of the present invention with some or all of the technical features included in another implementation of the present invention so as to form a single independent implementation of the present invention.

The present invention can also be implemented as various types of implementations other than a tank capable of supplying a liquid to a liquid ejection head, a tank unit including the tank, and a liquid ejection system including the tank. For example, the present invention can be implemented as a tank capable of supplying a liquid to an apparatus other than a liquid ejection head, a tank unit including the tank, and a system including the tank. In addition thereto, the present invention can be implemented as a fluid flow path structure for use in a tank. The term "system" as used in this specification refers to a set of a plurality of constituent elements provided in an integrated or dispersed manner and combined such that their respective functions directly or indirectly interact with each other, so as to implement at least one function. Accordingly, the system as used in this specification also encompasses an "apparatus" in which a plurality of constituent elements are integrally combined.

BRIEF DESCRIPTION OF DRAWINGS

FIGS. 5A, 5B, 5C, and 5D show schematic diagrams illustrating the states of ink contained in the ink tank when the ink tank is rotated from a reference orientation.

DESCRIPTION OF EMBODIMENTS

A. First Embodiment

Configuration of Printer

Figure 1:
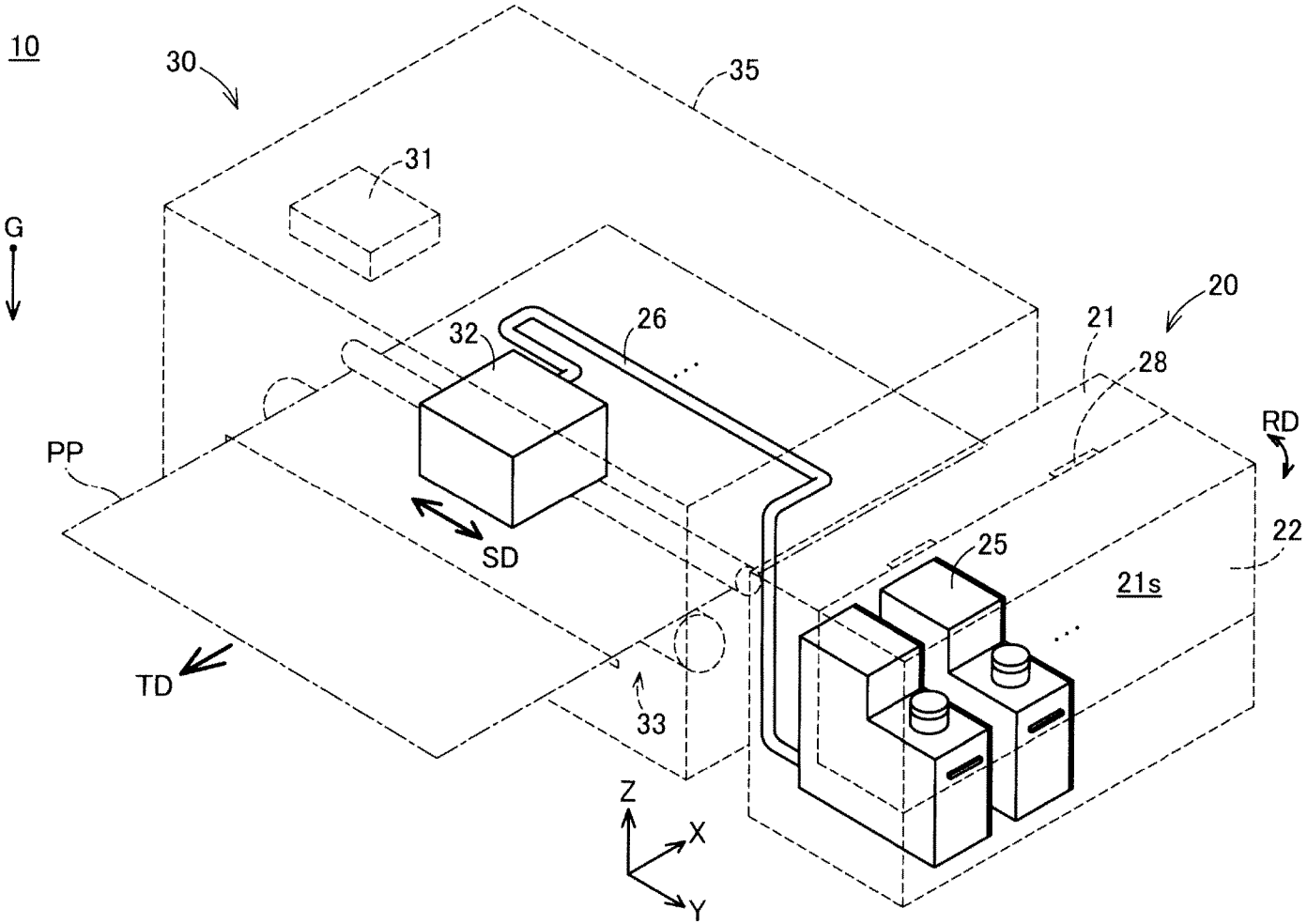
FIG. 1 is a schematic diagram showing a configuration of an inkjet printer.

FIG. 1 is a schematic diagram showing a configuration of an inkjet printer 10 (hereinafter referred to simply as "printer 10") including an ink tank 25 according to a first embodiment of the present invention. In FIG. 1, an arrow G indicating the direction of gravity (vertical direction) when the printer 10 is in a normal state of use is shown. In the following description, unless otherwise stated, the terms "up" and "down" refer to the up-down direction with respect to the direction of gravity. Also, in FIG. 1, arrows X, Y, and Z indicating three directions that are mutually perpendicular with respect to the ink tank 25 are shown. The directions indicated by the arrows X, Y, and Z will be described later. The arrows G, X, Y, and Z are also shown as appropriate in the diagrams which will be referred to in connection with the following description.

The printer 10 is one aspect of a liquid ejection system, and forms images by discharging ink droplets onto print paper PP (indicated by a dash dot line), which is a print medium. The printer 10 includes a tank unit 20 and a printing portion 30. The tank unit 20 includes a casing portion 21 (indicated by a broken line), which is an outer jacket, a plurality of ink tanks 25, and a plurality of tubes 26. The plurality of ink tanks 25 correspond to a subordinate concept of the tank according to the present invention, and contain inks of mutually different colors. The inks contained in the ink tanks 25 are supplied to the printing portion 30 via the flexible resin tubes 26 connected to the ink tanks 25 in a one-to-one correspondence. A description of a configuration of the ink tanks 25 will be given later.

In the tank unit 20, the ink tanks 25 are linearly aligned in a direction indicated by the arrow X, which will be described later, and in this state, they are fixed in an internal space 21*s* of the casing portion 21. The casing portion 21 includes a cover portion 22. The cover portion 22 is connected to the main body of the casing portion 21 by a hinge mechanism 28, and is configured to be opened and closed by being swung in a direction indicated by an arrow RD. By opening the cover portion 22, the user of the printer 10 can perform operations such as attaching or detaching the ink tank 25 to or from the tank unit 20, and loading ink into the ink tank 25, which will be described later. In addition thereto, the tank unit 20 may be provided with an electric circuit and wiring for exchanging electric signals representing ink information such as the remaining amounts of ink in the ink tanks 25 with the printing portion 30.

The printing portion 30 includes a control portion 31, a print head portion 32, a conveyance mechanism 33 for conveying the print paper PP, and a casing portion 35. The casing portion 35 serves as the outer jacket of the printing portion 30, and houses therein a print head portion 32, a conveyance mechanism 33, and a control portion 31. The control portion 31 is implemented by, for example, a microcomputer including a central processing unit and a main storage device. As a result of the central processing unit reading various programs to the main storage device and executing the programs, the control portion 31 provides at least a function of controlling the printing portion 30 to execute print processing based on externally input print data.

The print head portion 32 is provided so as to be capable of reciprocal movement in a main scanning direction SD on a conveyance path along which the print paper PP is conveyed. The print head portion 32 is connected to the ink tanks 25 of the tank unit 20 via the above-described tubes 26, and is capable of discharging ink supplied from the ink tanks 25. The print head portion 32 corresponds to a subordinate concept of the liquid ejection head according to the present invention.

The conveyance mechanism 33 is capable of conveying the print paper PP in a conveyance direction TD that intersects the main scanning direction SD by driving conveyance rollers to rotate. At the time of printing, under control of the control portion 31, the conveyance mechanism 33 conveys the print paper PP, and the print head portion 32 discharges ink droplets while reciprocally moving in the main scanning direction SD, whereby a print image is formed on the print surface of the print paper PP. The printing portion 30 corresponds to a subordinate concept of the liquid ejection apparatus according to the present invention.

In the present embodiment, the casing portion 21 of the tank unit 20 and the casing portion 35 of the printing portion 30 are connected so as to be capable of detachment and rotation (illustration omitted). In this way, because the tank unit 20 and the printing portion 30 are configured as separate bodies, it is possible to separately maintain the tank unit 20 and the printing portion 30, and thus the ease of maintenance of the printer 10 is enhanced.

Configuration of Ink Tank

Figure 2:
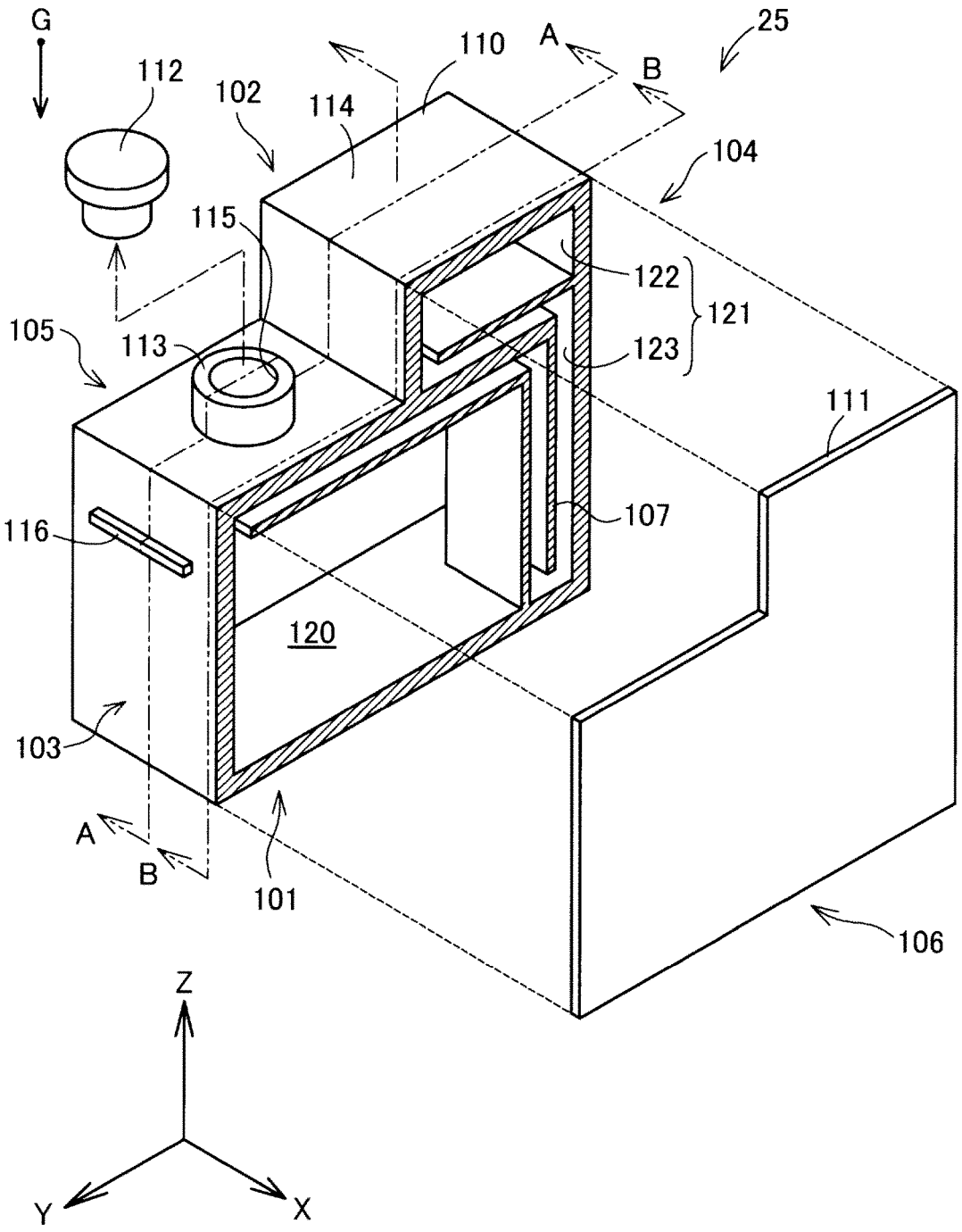
FIG. 2 is a schematic exploded perspective view of an ink tank.
Figure 3:
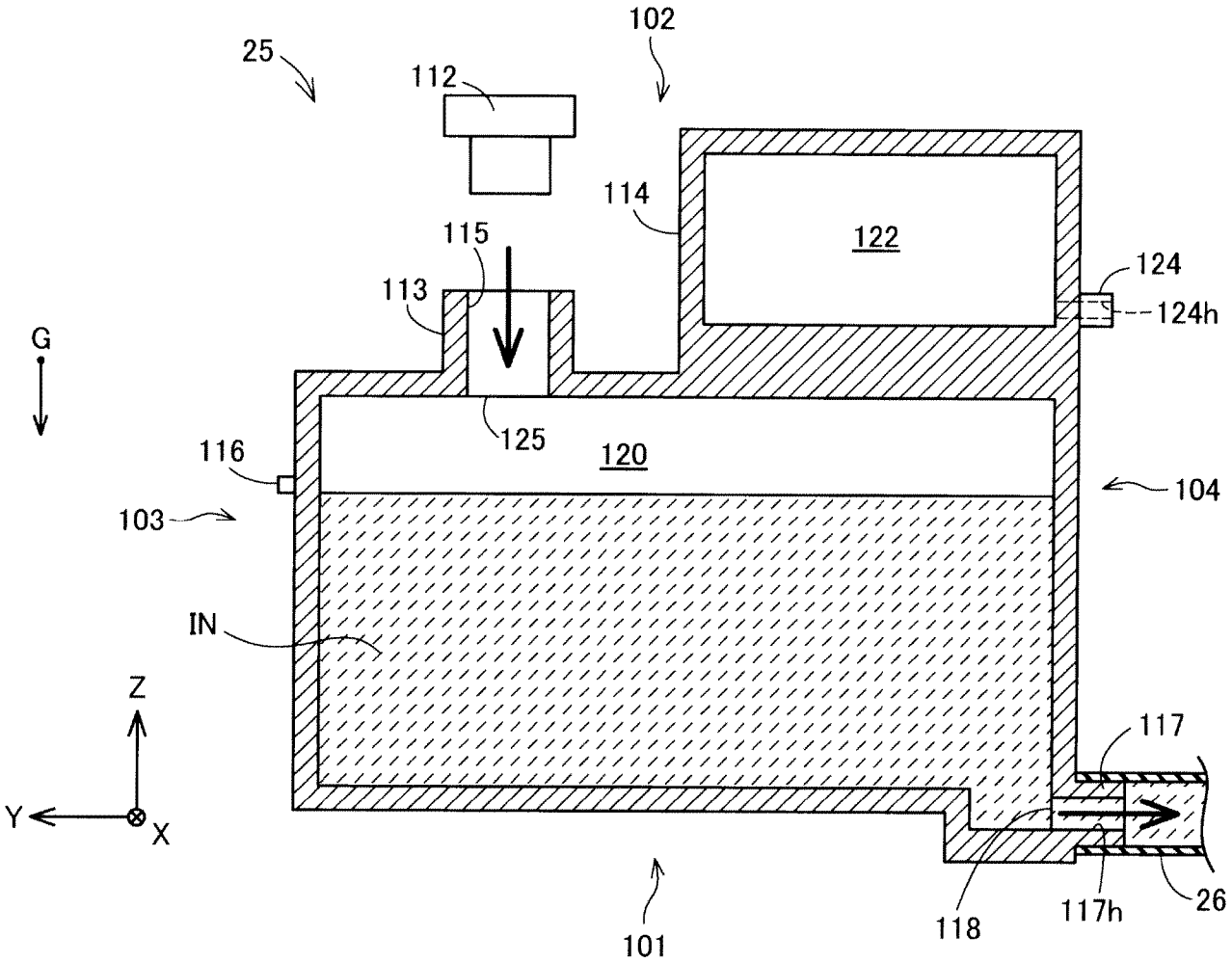
FIG. 3 is a schematic cross-sectional view of the ink tank.
Figure 4:
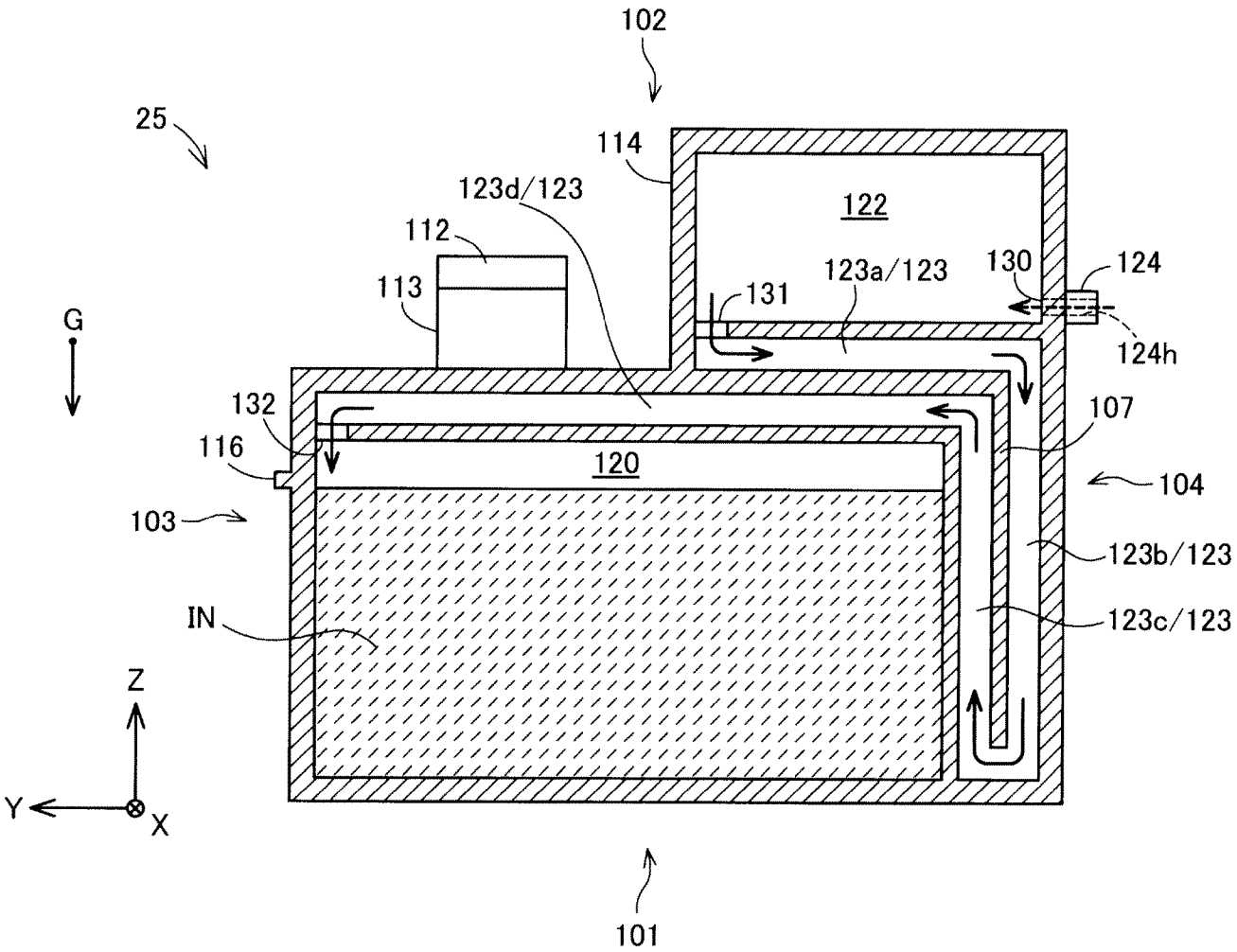
FIG. 4 is a schematic cross-sectional view of the ink tank.

A configuration of an ink tank 25 will be described with reference to FIGS. 2 to 4, in addition to FIG. 1. FIG. 2 is a schematic exploded perspective view of an ink tank 25. FIG. 3 is a schematic cross-sectional view of the ink tank 25 taken along the line A-A shown in FIG. 2, and FIG. 4 is a schematic cross-sectional view of the ink tank 25 taken along the line B-B shown in FIG. 2. FIGS. 3 and 4 show a state in which ink IN is stored in an ink containing portion 120.

The ink tank 25 is configured as a hollow container including six surface portions 101 to 106. The six surface portions 101 to 106 will be described based on an orientation of the ink tank 25 in a state of use as a reference. As used herein, the expression "the ink tank 25 in a state of use" encompasses a state in which the ink tank 25 is attached to the tank unit 20 of the printer 10 (FIG. 1), a state in which the ink tank 25 is supplying ink to the printer 10, and a state in which ink is loaded by the user. Hereinafter, the orientation of the ink tank 25 in a state of use will also be referred to as "reference orientation". The reference orientation corresponds to a subordinate concept of the first orientation according to the present invention. In the following description, unless otherwise stated, the orientation of the ink tank 25 is in the reference orientation.

In the ink tank 25, a first surface portion 101 constitutes a bottom surface portion that faces downward, and a second surface portion 102 constitutes an upper surface portion that faces upward (FIGS. 1 and 2). A third surface portion 103 intersects with the first surface portion 101 and the second surface portion 102, and constitutes a front surface portion that faces toward the user when the cover portion 22 of the casing portion 21 of the tank unit 20 is opened. A fourth surface portion 104 intersects with the first surface portion 101 and the second surface portion 102, and constitutes a rear surface portion that faces in a direction opposite to the third surface portion 103. A fifth surface portion 105 intersects with each of the four surface portions 101 to 104, and constitutes a left side surface portion that is located on the left as viewed from directly in front of the third surface portion 103. A sixth surface portion 106 intersects with each of the four surface portions 101 to 104, and constitutes a right side surface portion that is located on the right, which is the side opposite to the fifth surface portion 105, as viewed from directly in front of the third surface portion 103. In this specification, the term "intersect" used to indicate that two surface portions intersect with each other refers to one of the following states: a state in which two surface portions actually intersect with each other; a state in which an extended surface of one surface portion intersects with another surface portion; and a state in which two surface portions intersect with each other.

Next is a description of the arrows X, Y, and Z indicating three directions with respect to the ink tank 25. The arrow X indicates a direction parallel to a width direction (right-left direction) of the ink tank 25, the direction extending from the fifth surface portion 105 toward the sixth surface portion 106. In the following description, the term "right" refers to the side in the direction of the arrow X, and the term "left" refers to the side in a direction opposite to the direction of the arrow X. The arrow Y indicates a direction parallel to a depth direction (front-rear direction) of the ink tank 25, the direction extending from the fourth surface portion 104 toward the third surface portion 103. In the following description, the term "front" refers to the side in the direction of the arrow Y, and the term "rear" refers to the side in a direction opposite to the direction of the arrow Y. The arrow Z indicates a height direction (up-down direction) of the ink tank 25, the direction extending from the first surface portion 101 toward the second surface portion 102. In the reference orientation, the arrow Z points in a direction opposite to the direction of gravity.

The ink tank 25 includes a case member 110, a sheet member 111, and a cap member 112 (FIG. 2). The case member 110 is a hollow box constituting the main body of the ink tank 25. The case member 110 is entirely open in the direction of the arrow X on the sixth surface portion 106 side, and the outer walls surrounding an internal space of the case member 110 respectively constitute five surface portions 101 to 105 excluding the sixth surface portion 106. The case member 110 is produced by, for example, integral molding using a synthetic resin such as nylon or polypropylene.

The second surface portion 102 of the case member 110 is provided with an ink injection portion 113 and a buffer chamber housing portion 114. The ink injection portion 113 corresponds to a subordinate concept of the liquid injection portion according to the present invention, and is a part that is in communication with an ink containing portion 120 (described later) included in the ink tank 25 such that ink can be injected therethrough. In the present embodiment, the ink injection portion 113 is configured as a cylindrical part protruding upward and has an opening.

The ink injection portion 113 is provided at a position close to the third surface portion 103 so that the user can easily access the ink tank 25 when it is attached to the tank unit 20. The cap member 112 is usually hermetically attached to an opening 115 of the ink injection portion 113. The user can load ink into the ink tank 25 via the ink injection portion 113 by detaching the cap member 112 therefrom.

The buffer chamber housing portion 114 is a hollow part having a substantially rectangular parallelepiped shape protruding upward on the rear side of the ink injection portion 113. An internal space of the buffer chamber housing portion 114 constitutes a buffer chamber 122, which will be described later.

In the present embodiment, a wall portion of the third surface portion 103 of the case member 110 is partially or entirely configured to be transparent or translucent so as to allow the user to view the position of the surface of the ink contained in the ink tank 25. Also, a mark portion 116 is provided on the wall surface of the third surface portion 103. The mark portion 116 indicates the position of the ink surface when a predetermined reference amount of ink is contained in the ink tank 25 when the ink tank 25 is in the reference orientation. That is, in the ink tank 25, the maximum amount (reference amount) of ink that needs to be contained in the ink tank 25 is specified by the indication of the mark portion 116. The mark portion 116 corresponds to a subordinate concept of the reference amount specifying portion according to the present invention.

In the ink tank 25 according to the present embodiment, the mark portion 116 is formed at a height position lower than an atmospheric air introducing inlet 132 (described later) provided in the ink containing portion 120. With this configuration, a situation is suppressed in which the surface of ink stored in the ink containing portion 120 reaches an ink injection inlet 125 when the user injects the ink by using the position of the mark portion 116 as the reference. The mark portion 116 may be formed as, for example, a protrusion or a recess on the wall surface portion of the third wall portion 103, or may be formed by printing or attaching a label.

The sheet member 111 is a member in the form of a thin film, and constitutes the sixth surface portion 106 of the ink tank 25 by being bonded to the case member 110 so as to seal the entirety of an opening of the case member 110. The sheet member 111 is made of a film member formed using, for example, a synthetic resin such as nylon or polypropylene. The sheet member 111 is bonded to the case member 110 through, for example, melt adhesion. In this way, with the case member 110 and the sheet member 111, the ink tank 25 according to the present embodiment is configured to be simple and lightweight.

In the ink tank 25, the internal space of the case member 110 is partitioned by an inner wall portion 107, and thereby an ink containing portion 120 and an atmospheric air introducing portion 121 are formed between the case member 110 and the sheet member 111. The ink containing portion 120 is a space in which ink can be stored. The atmospheric air introducing portion 121 is a flow path space for introducing atmospheric air outside of the ink tank 25 into the ink containing portion 120. The ink tank 25 is configured such that atmospheric air is introduced into the ink containing portion 120 via the atmospheric air introducing portion 121 along with the ink stored in the ink containing portion 120 being supplied to the print head portion 32 and consumed.

The ink containing portion 120 is formed so as to extend over the width direction and the front-rear direction of the ink tank 25 (FIGS. 2 and 3). The ink containing portion 120 is an internal space in which an ink can be stored. The ink containing portion 120 corresponds to a subordinate concept of the liquid containing portion according to the present invention. The ink containing portion 120 is connected to the ink injection portion 113 in an upper area of the ink containing portion 120 (FIG. 3). An opening serving as an ink injection inlet 125 is formed in an area of an upper surface of the ink containing portion 120 where the upper surface of the ink containing portion 120 intersects with the ink injection portion 113.

At a lower end portion of the fourth surface portion 104 of the ink tank 25, an ink supply portion 117 for supplying ink to the print head portion 32 is provided. The ink supply portion 117 is configured as a cylindrical part having an opening and protruding from a wall surface of the fourth surface portion 104 toward the rear side. A tube 26 is hermetically connected to the ink supply portion 117, the tube 26 being connected to the print head portion 32 (FIG. 1). The ink supply portion 117 has a cylindrical hole **117*h* that is in communication with a lower end portion of the ink containing portion 120. An opening serving as an ink supply inlet 118 is formed in an area of a bottom surface of the ink containing portion 120 where the bottom surface of the ink containing portion 120 intersects with the ink supply portion 117. In the ink containing portion 120**, a sensor portion for detecting an out-of-ink state, and the like may be housed.

The atmospheric air introducing portion 121 (FIGS. 2 and 4) includes a buffer chamber 122 and an atmospheric air communication path 123. The buffer chamber 122 is a space capable of containing atmospheric air. As described above, the buffer chamber 122 is provided in the buffer chamber housing portion 114 of the second surface portion 102, and is located above the ink containing portion 120. The buffer chamber 122 is formed as an internal space having a greater depth in the direction of the arrow X than the atmospheric air communication path 123. The buffer chamber 122 is in communication with the outside of the ink tank 25 via an atmospheric air intake portion 124. The atmospheric air intake portion 124 is configured as a cylindrical part having an opening and protruding from the wall surface of the fourth surface portion 104 toward the rear side. The atmospheric air intake portion 124 has a cylindrical hole **124*h* that is in communication with a lower end portion of the buffer chamber 122. An opening serving as an atmospheric air intake inlet 130 is formed in an area where the buffer chamber 122 and the atmospheric air intake portion 124** intersect with each other.

The atmospheric air communication path 123 is a flow path that connects the buffer chamber 122 and the ink containing portion 120 (FIG. 4). The atmospheric air communication path 123 includes a first path portion **123*a*, a second path portion 123*b*, a third path portion 123*c*, and a fourth path portion 123*d*. In an end portion of the buffer chamber 122 that is on the third surface portion 103 side, the first path portion 123*a* is connected to the buffer chamber 122 via a communication inlet 131. The communication inlet 131 is open in the direction of the arrow Z in a bottom surface of the buffer chamber 122. At a position below the buffer chamber 122, the first path portion 123*a* extends to an end portion that is on the fourth surface portion 104 side in parallel to the direction of the arrow Y. In the present embodiment, the communication inlet 131 that is in communication with the buffer chamber 122 corresponds to a subordinate concept of the first communication inlet according to the present invention, and the atmospheric air intake inlet 130** corresponds to a subordinate concept of the second communication inlet according to the present invention.

In the end portion that is on the fourth surface portion 104 side, the second path portion **123*b* is bent downward from the first path portion 123*a* and extends to an end portion of the ink tank 25 that is on the first surface portion 101 side. The third path portion 123***c* is bent upward from a lower end portion of the second path portion 123*b*, extends in parallel to the second path portion 123*b* to a position below the first path portion 123*a*, and is connected to the fourth path portion 123*d* located in an upper end portion of the ink containing portion 120. The fourth path portion 123*d* extends in the direction of the arrow Y to an end portion that is on the third surface portion 103 side, and is connected to the ink containing portion 120. In the upper surface of the ink containing portion 120 where the atmospheric air communication path 123 and the ink containing portion 120 intersect with each other, an atmospheric air introducing inlet 132 that is open in the direction of the arrow Z is formed. When the ink tank 25 is in the reference orientation, the atmospheric air introducing inlet 132 is located on an upper end side that is closer to the upper end portion of the ink containing portion 120 rather than to the lower end portion of the ink containing portion 120.

In the ink tank 25 according to the present embodiment, the atmospheric air communication path 123 is formed as a groove in the case member 110 so as to face the sheet member 111. The second path portion 123*b*, the third path portion 123*c*, and the fourth path portion 123*d* of the atmospheric air communication path 123 are formed at positions overlapping the ink containing portion 120 as viewed in the direction of the arrow X (FIGS. 3 and 4). Also, the communication inlet 131 of the buffer chamber 122 and the atmospheric air introducing inlet 132 of the ink containing portion 120 are formed as spaces between the sheet member 111 and gaps of the inner wall portion 107 of the case member 110.

The ink tank 25 with ink being contained therein may be oriented at various angles when, for example, the printer 10 is transported. Accordingly, depending on the orientation of the ink tank 25, the ink contained in the ink containing portion 120 may flow into the atmospheric air introducing portion 121. In particular, as described above, the ink tank 25 is configured such that the amount of ink contained in the ink containing portion 120 is specified to the reference amount that is less than a completely full state, and thus air is usually present in an upper portion of the ink containing portion 120. For this reason, there is a possibility that the flow of ink into the atmospheric air introducing portion 121 may be facilitated by the influence of the air. With the ink tank 25, even if the ink contained in the ink containing portion 120 flows into the atmospheric air introducing portion 121, the above-described flow path configuration of the atmospheric air introducing portion 121 suppresses the occurrence of leakage from the atmospheric air introducing portion 121 to the outside in the manner described below.

The mechanism that suppresses ink leakage in the ink tank 25 will be described by making reference to FIGS. 5 to 7 in sequence. In FIG. 5, (a) to (d) show the states of an ink IN contained in the ink tank 25 when the ink tank 25 is rotated from the reference orientation in a predetermined first or second direction. As used herein, the term "first direction" refers to a clockwise direction when the ink tank 25 is viewed in the direction of the arrow X. The term "second direction" refers to a counter-clockwise direction when the ink tank 25 is viewed in the direction of the arrow X.

When the ink tank 25 is in the reference orientation ((a) in FIG. 5), the surface of the ink IN stored in the ink containing portion 120 is located below the atmospheric air introducing inlet 132 unless the user injects the ink IN in an amount more than the reference amount, and thus a situation is suppressed in which the ink IN stored in the ink containing portion 120 flows from the atmospheric air introducing inlet 132 into the atmospheric air introducing portion 121.

When the ink tank 25 is rotated by 90° in the first direction from the reference orientation, the third surface portion 103 faces up, and the fourth surface portion 104 faces down ((b) in FIG. 5). This orientation corresponds to an aspect of the second orientation according to the present invention. Hereinafter, the orientation will also be referred to as "90° rotated-right orientation". When the ink tank 25 is in the 90° rotated-right orientation, the atmospheric air introducing inlet 132 is located in an upper end of the ink containing portion 120. Accordingly, a situation is suppressed in which the ink IN stored in the ink containing portion 120 flows from the atmospheric air introducing inlet 132 into the atmospheric air introducing portion 121.

Also, in this orientation, the second path portion 123*b* and the third path portion 123*c* are located in a lower end of the ink tank 25, and the first path portion 123*a* extends upward to the communication inlet 131 located in an upper end of the buffer chamber 122. Accordingly, even if a portion of the ink IN stored in the ink containing portion 120 flows into the atmospheric air communication path 123, a situation is suppressed in which the ink reaches the buffer chamber 122.

When the ink tank 25 is rotated by 90° in the second direction from the reference orientation, the fourth surface portion 104 faces up, and the third surface portion 103 faces down ((c) in FIG. 5). This orientation also corresponds to an aspect of the second orientation according to the present invention. Hereinafter, the orientation will also be referred to as "90° rotated-left orientation". When the ink tank 25 is in the 90° rotated-left orientation, the fourth path portion 123*d* extends from the atmospheric air introducing inlet 132 located in a lower end of the ink containing portion 120 to a height position of the upper end of the ink containing portion 120. Accordingly, a situation is suppressed in which the ink IN stored in the ink containing portion 120 passes through the fourth path portion 123*d* and reaches the third path portion 123*c* and the second path portion 123*b* located above the third path portion 123*c*.

When the ink tank 25 is rotated by 180° in the first direction or the second direction from the reference orientation, the first surface portion 101 faces up, and the second surface portion 102 faces down ((d) in FIG. 5). This orientation corresponds to an aspect of the third orientation according to the present invention. Hereinafter, the orientation will also be referred to as "180° rotated orientation". When the ink tank 25 is in the 180° rotated orientation, the turn-back position where the second path portion 123*b* and the third path portion 123*c* communicate with each other is located above the fourth path portion 123*d*, and is located in a height position of the upper end of the ink containing portion 120. Accordingly, a situation is suppressed in which the ink IN that has flowed into the fourth path portion 123*d* from the ink containing portion 120 via the ink injection inlet 125 passes through the third path portion 123*c* and flows into the second path portion 123*b*.

In the orientations of the ink tank 25 as shown in (a) to (d) in FIG. 5, a region between the height position of the upper end portion of the ink containing portion 120 and a height position of a midpoint between the height position of the upper end portion and the height position of the lower end portion of the ink containing portion 120 will be referred to as "the upper region HA of the ink tank 25". The expression "the upper end portion of the ink containing portion 120" refers to an area located at the highest height position of the ink containing portion 120, and the expression "the lower end portion of the ink containing portion 120" refers to an area located at the lowest height position of the ink containing portion 120. The upper region HA of the ink tank 25 also includes upper wall surfaces of the upper end portion of the ink containing portion 120.

In the ink tank 25 according to the present embodiment, as will be described below, when the ink tank 25 is in any of the above-described orientations, at least a portion of the atmospheric air communication path 123 is located in a height position of the upper end portion of the ink containing portion 120. As long as at least a portion of the atmospheric air communication path 123 is located in the upper region HA of the ink tank 25, it is possible to obtain an ink leakage suppression effect, which will be described later.

When the ink tank 25 according to the present embodiment is in the reference orientation ((a) in FIG. 5), a portion of the second path portions 123*b* and the third path portion 123*c* is located in the upper region HA. In the present embodiment, this portion of the second path portions 123*b* and the third path portion 123*c* corresponds to a subordinate concept of the first portion according to the present invention.

When the ink tank 25 is in the 90° rotated-right orientation ((b) in FIG. 5), a portion of the fourth path portion 123*d* is located in the upper region HA. When the ink tank 25 is in the 90° rotated-left orientation ((c) in FIG. 5), a portion of the first path portion 123*a*, the second path portion 123*b*, the third path portion 123*c*, and a portion of the fourth path portion 123*d* are located in the upper region HA. In the present embodiment, the portions of the path portions 123*a* to 123*d* correspond to a subordinate concept of the second portion according to the present invention. When the ink tank 25 is in the 180° rotated orientation ((d) in FIG. 5), a portion of the second path portion 123*b* and a portion of the third path portion 123*c* are located in the upper region HA. In the present embodiment, the portions of the second path portion 123*b* and the third path portion 123*c* correspond to a subordinate concept of the third portion according to the present invention.

As described above, in the ink tank 25 according to the present embodiment, when the ink tank 25 is in any of the above-described orientations, at least a portion of the atmospheric air communication path 123 is located in the upper region HA. As a result, under the action of gravity, a situation is suppressed in which the ink IN stored in the ink containing portion 120 reaches the buffer chamber 122 via the atmospheric air communication path 123. Accordingly, even if the ink tank 25 is rotated in the first direction or the second direction from the reference orientation, a situation is suppressed in which the ink IN leaks to the outside via the atmospheric air introducing portion 121. In particular, in the ink tank 25 according to the present embodiment, when the ink tank 25 is in any of the orientations, at least a portion of the atmospheric air communication path 123 is located at a height position of the upper end portion of the ink containing portion 120, and it is therefore possible to obtain a higher ink leakage suppression effect.

Figure 6:
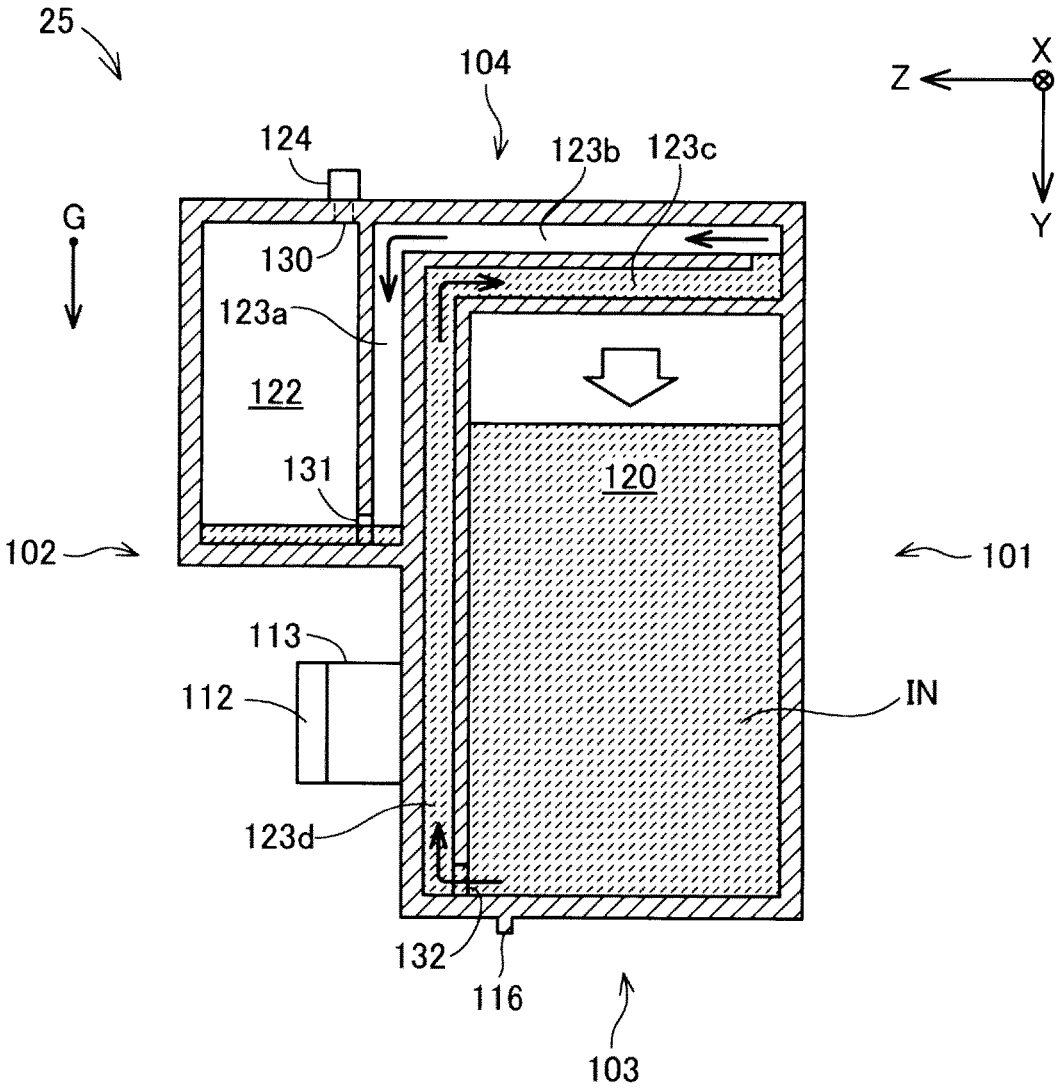
FIG. 6 is a schematic diagram for illustrating a mechanism that suppresses ink leakage.
Figure 7:
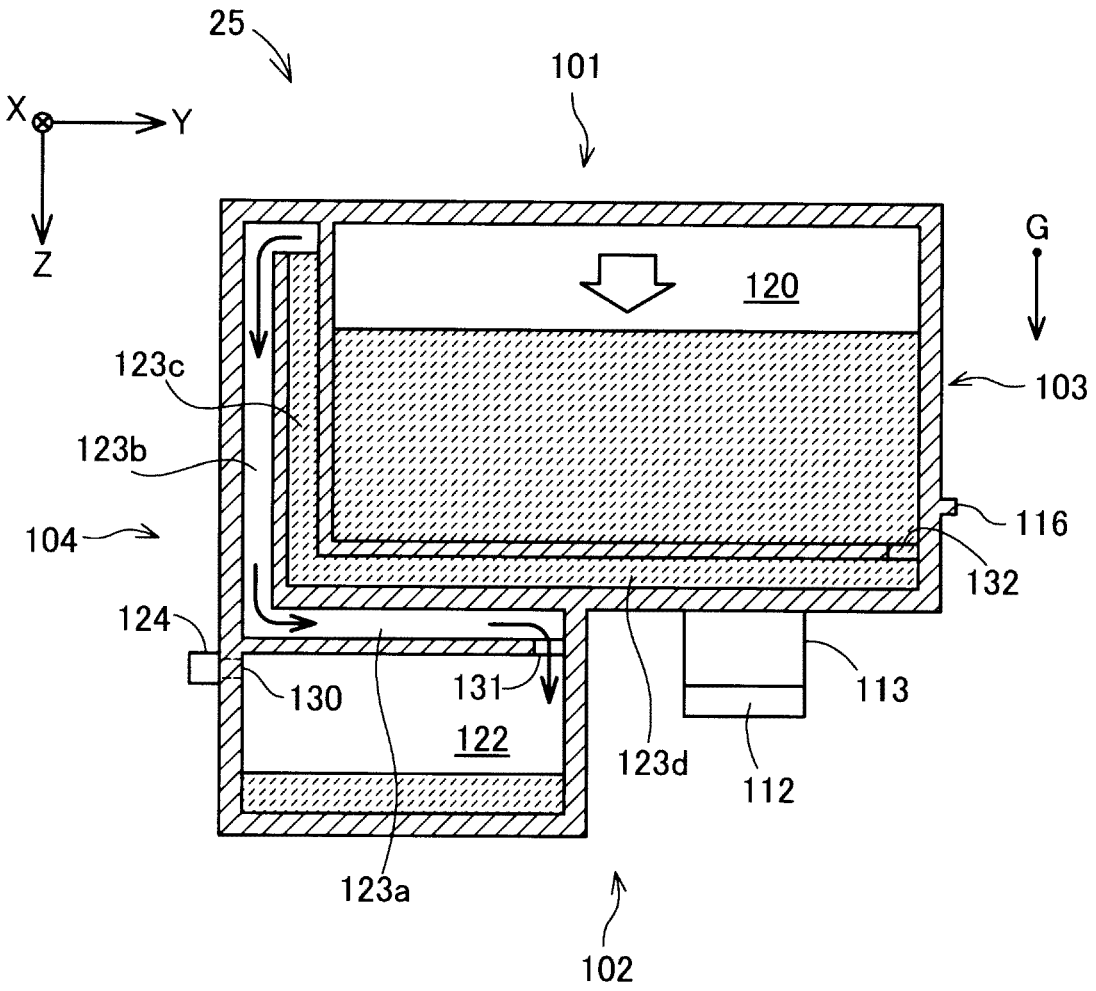
FIG. 7 is a schematic diagram for illustrating a mechanism that suppresses ink leakage.

FIG. 6 schematically shows an internal state of the ink tank 25 when the ink tank 25 is in a 90° rotated-left orientation similar to that shown in (c) in FIG. 5. FIG. 7 schematically shows an internal state of the ink tank 25 when the ink tank 25 is in a 180° rotated orientation similar to that shown in (d) in FIG. 5. When the ink tank 25 is in either of the orientations shown in FIGS. 6 and 7, the atmospheric air introducing inlet 132 is located in the lower end of the ink containing portion 120, and therefore quite a large amount of the ink IN stored in the ink containing portion 120 flows from the atmospheric air introducing inlet 132 to the fourth path portion 123*d* of the atmospheric air communication path 123 due to gravity. Also, unless the ink tank 25 contains the ink IN in an amount more than the capacity of the ink containing portion 120, air is present above the surface of the ink IN in the ink containing portion 120. If the air in the ink containing portion 120 expands along with an increase in the outside temperature, a decrease in the outside pressure, or the like, the ink IN stored in the ink containing portion 120 is forced out and may reach the buffer chamber 122 via the atmospheric air communication path 123.

In contrast, with the ink tank 25 according to the present embodiment, the atmospheric air intake inlet 130 that is in communication with the outside is located in the upper end portion of the buffer chamber 122. As a result of the atmospheric air intake inlet 130 being located above the lower end portion of the buffer chamber 122 as described above, quite a large amount of the ink IN that has been forced out from the atmospheric air communication path 123 due to the air in the ink containing portion 120 expanding is stored in the buffer chamber 122. Accordingly, leakage of the ink IN from the ink tank 25 is suppressed.

The amount of the ink IN forced out to the buffer chamber 122 from the ink containing portion 120 by the expansion of the air in the ink containing portion 120 corresponds to an amount obtained by subtracting the capacity of the atmospheric air communication path 123 from the volume of air increased by expansion in the ink containing portion 120. Accordingly, in order to reliably store, in the buffer chamber 122, the ink IN forced out due to the air expanding due to changes in the air pressure and temperature of the ink containing portion 120, it is desirable that the buffer chamber 122 has a capacity that satisfies a relationship represented by the following inequality expression (1):

$$V > Va \times \alpha - Vb \quad (1).$$

In the inequality expression (1) given above, V represents the capacity of the buffer chamber 122. Va is a value obtained by subtracting, from the capacity of the ink containing portion 120, the volume of the predetermined reference amount of the ink IN specified by the mark portion 116 at room temperature at an altitude of 0 meters. In other words, Va corresponds to the volume of air contained in the ink containing portion 120 when the ink containing portion 120 contains a predetermined reference amount of the ink IN. Vb corresponds to the capacity of the atmospheric air communication path 123.

$\alpha$ is a predetermined coefficient of 1 or less. It is desirable that $\alpha$ is a value in which an air expansion coefficient is reflected so that $Va \times \alpha$ represents the volume of air increased by expansion in the ink containing portion 120. As used herein, the term "air expansion coefficient" refers to the proportion of the range of variations in the volume of air with respect to the range of altitude and the range of operation temperature in a usage environment specified in advance for the ink tank 25. That is, the air expansion coefficient refers to the proportion of the range of variations in the volume of air with respect to the range of altitude and the range of ambient temperature (for example, about −10 to 50° C.) in which the ink tank 25 is expected to be installed. To be specific, $\alpha$ is preferably a value within a range of 0.1 or more and 0.5 or less, and more preferably a value within a range of 0.15 or more and 0.3 or less.

In order to reduce the size of the ink tank 25, it is preferable that the buffer chamber 122 and the atmospheric air communication path 123 have a small capacity. In order to store the ink forced out from the ink containing portion 120 due to the air expanding, the buffer chamber 122 only need to have a capacity corresponding to the amount of expansion of the air in the ink containing portion 120, given that the capacity of the atmospheric air communication path 123 is negligibly small. Accordingly, the buffer chamber 122 preferably has a capacity that satisfies a relationship represented by the following inequality expression (2):

$$V > Va \times \alpha \quad (2).$$

As described above, in the ink tank 25 according to the present embodiment, the ink that has flowed into the atmospheric air introducing portion 121 is stored in the buffer chamber 122, and thus the occurrence of leakage of the ink to the outside is suppressed. In addition, when the ink tank 25 according to the present embodiment is in the reference orientation, the communication inlet 131 that communicates between the buffer chamber 122 and the atmospheric air communication path 123 is located in the lower end portion of the buffer chamber 122. Accordingly, even if the ink accidentally flows into the buffer chamber 122, the ink is guided from the buffer chamber 122 to the atmospheric air communication path 123 by gravity and airflow. Accordingly, the occurrence of leakage of the ink from the buffer chamber 122 is further suppressed.

Summary

As described above, with the ink tank 25 according to the first embodiment, with the flow path configuration of the atmospheric air communication path 123, a situation is suppressed in which the ink leaks to the outside from the ink containing portion 120 via the atmospheric air introducing portion 121. Also, even when the ink tank 25 is placed under an environment where the air in the ink containing portion 120 expands, a situation is suppressed in which the ink contained in the ink tank 25 is forced to the outside via the atmospheric air introducing portion 121 by expansion of the air.

B. Second Embodiment

Figure 8:
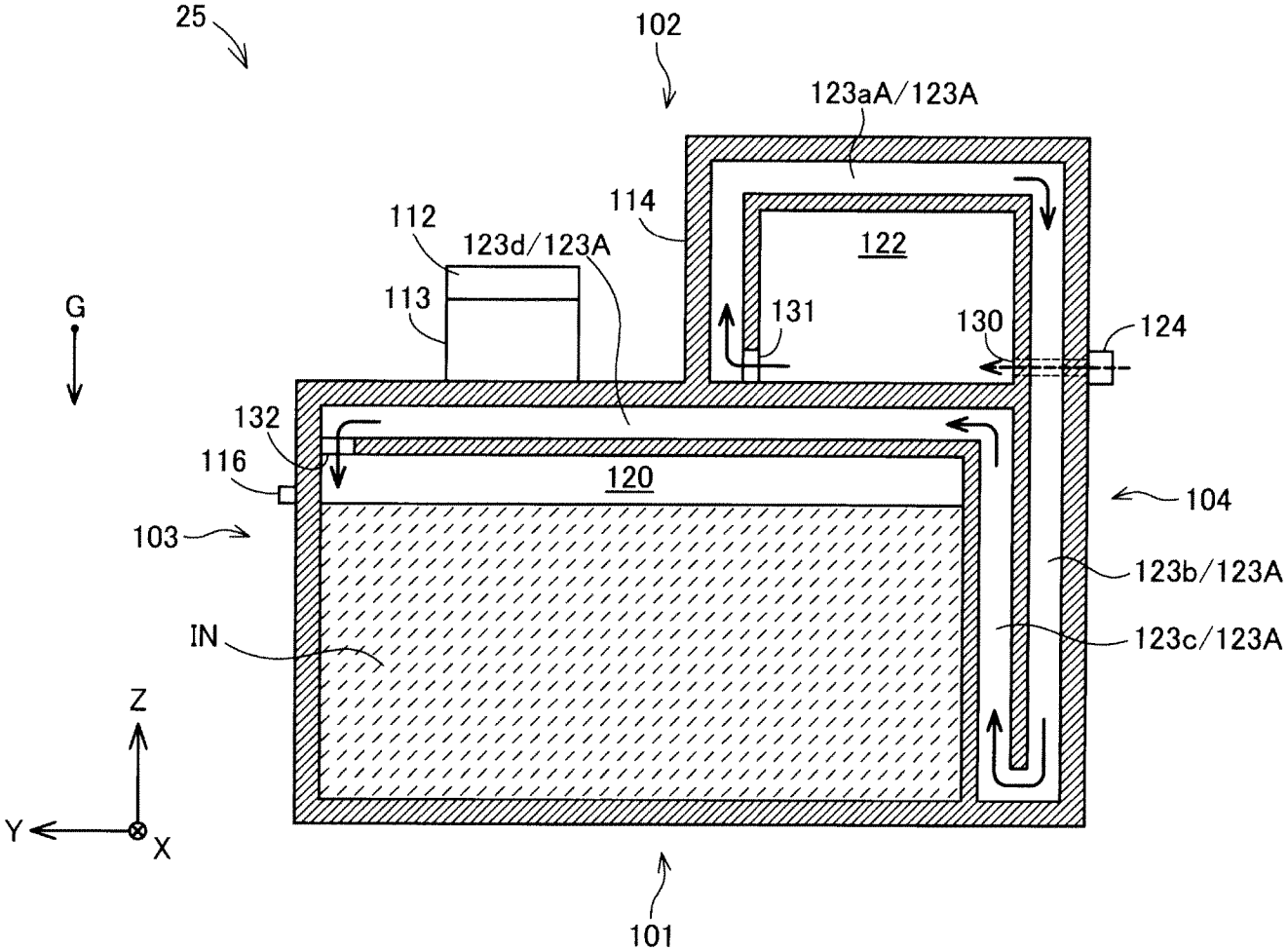
FIG. 8 is a schematic cross-sectional view showing a configuration of an ink tank according to a second embodiment.

FIG. 8 is a schematic diagram showing a configuration of an ink tank 25A according to a second embodiment of the present invention. The ink tank 25A according to the second embodiment has substantially the same configuration as the ink tank 25 according to the first embodiment, except that an atmospheric air communication path 123A has a different configuration. In the following description and the diagrams that will be referred to, the same constituent elements as those described in the first embodiment or corresponding constituent elements are given the same reference numerals as those used in the first embodiment.

The atmospheric air communication path 123A according to the second embodiment is substantially the same as the atmospheric air communication path 123 according to the first embodiment, except that a first path portion 123*a*A is provided instead of the first path portion 123*a*. The first path portion 123*a*A is configured as a flow path that passes through an upper end side of the buffer chamber 122, rather than a lower end side of the buffer chamber 122, when the ink tank 25 is in the reference orientation. The first path portion 123*a*A extends upward from the communication inlet 131 provided in a lower end portion of the buffer chamber 122 that is on the third surface portion 103 side, also extends along an outer periphery of the buffer chamber 122, is bent downward at an end portion that is on the fourth surface portion 104 side, and is connected to the second path portion 123*b*.

With the ink tank 25A according to the second embodiment as well, when it is in any of the following orientations: 90° rotated-right orientation; 90° rotated-left orientation; and 180° rotated orientation, at least a portion of the atmospheric air communication path 123A is located in the upper region HA (FIG. 5) of the ink containing portion 120 described with reference to FIG. 5. Accordingly, as in the ink tank 25 according to the first embodiment, the occurrence of ink leakage caused by the orientation of the ink tank 25A being rotated is suppressed. Also, in the ink tank 25A according to the second embodiment as well, when it is in an orientation in which the atmospheric air introducing inlet 132 is located on a lower end side of the ink containing portion 120, the atmospheric air intake inlet 130 of the buffer chamber 122 is located above the lower end portion of the buffer chamber 122. Accordingly, as in the ink tank 25 according to the first embodiment, even if the air in the ink containing portion 120 expands, a situation is suppressed in which quite a large amount of ink that has been forced out is stored in the buffer chamber 122 and leaks out to the outside. In addition, the ink tank 25A according to the second embodiment can provide the same advantageous effects as the ink tank 25 according to the first embodiment.

C. Third Embodiment

Figure 9:
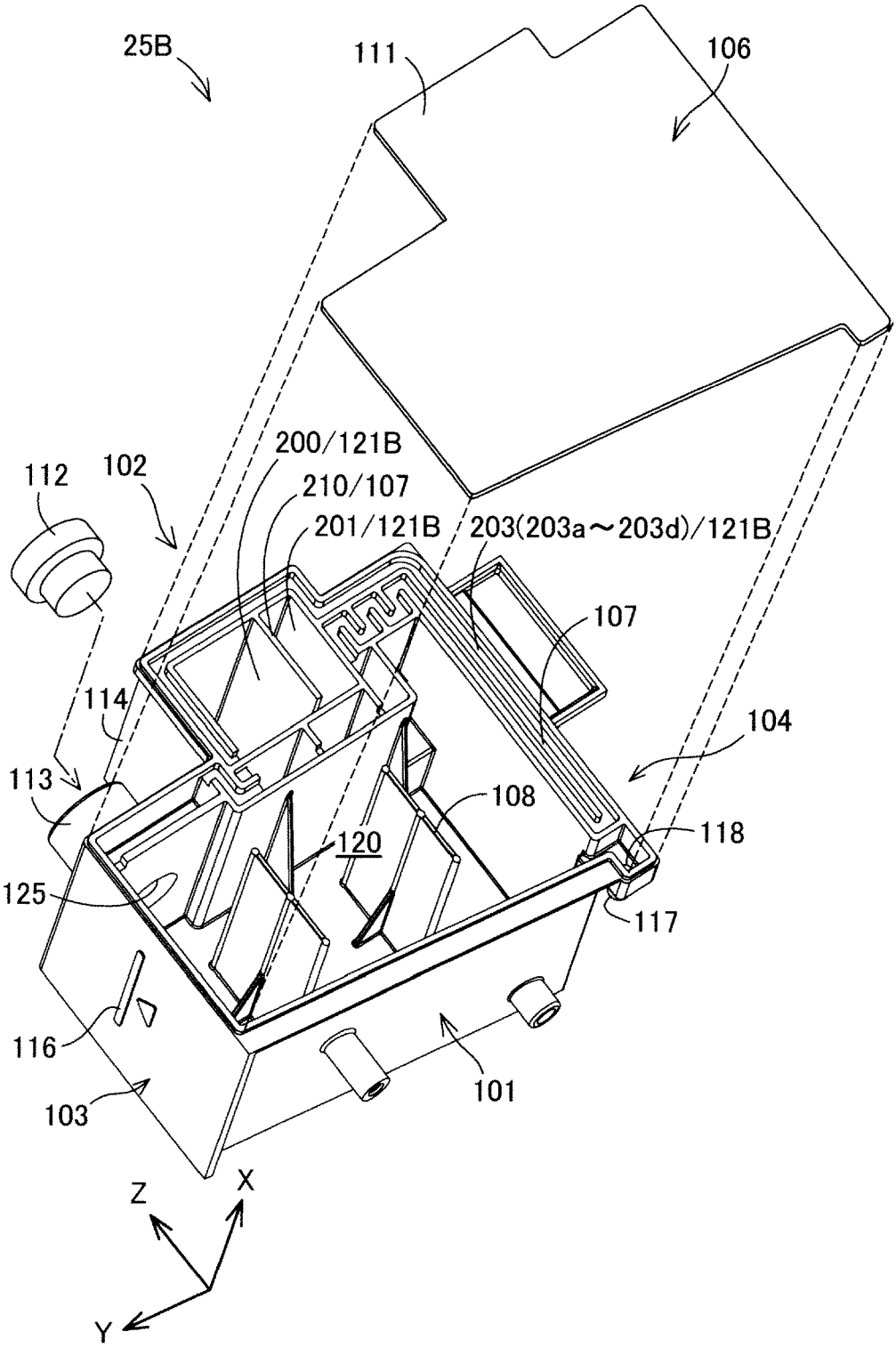
FIG. 9 is an exploded perspective view showing a configuration of an ink tank according to a third embodiment.
Figure 10:
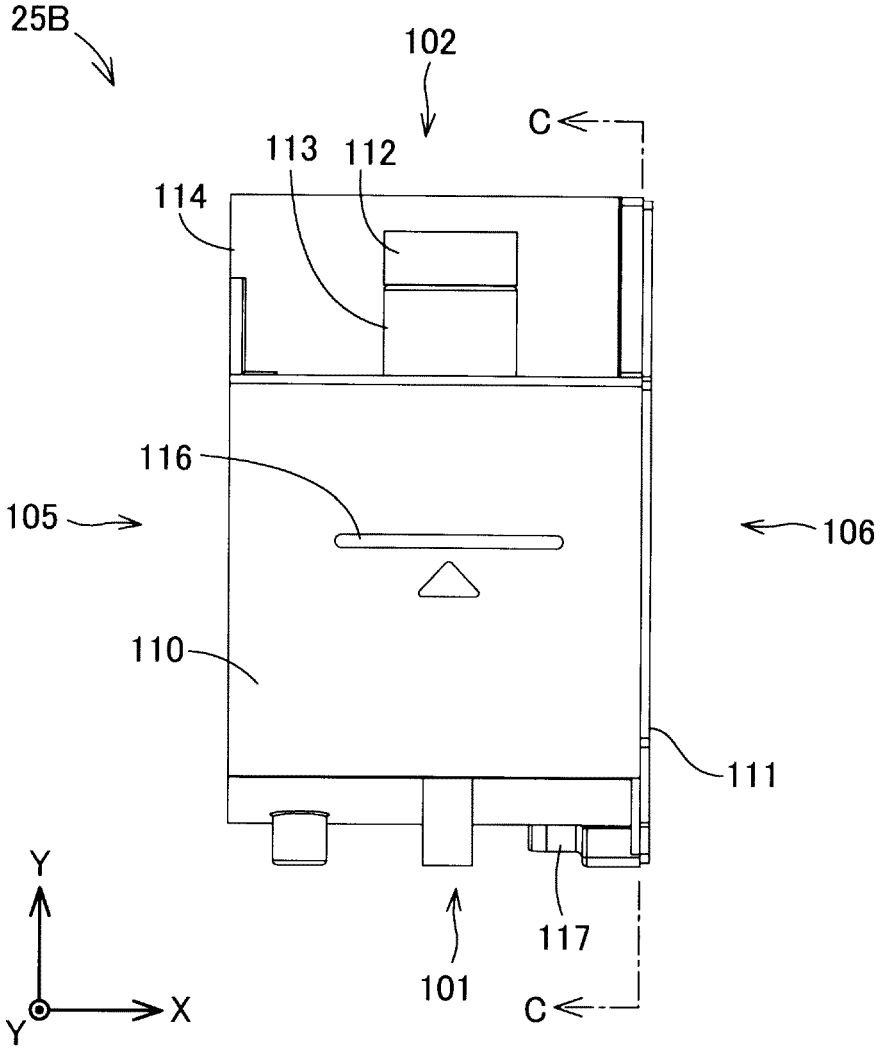
FIG. 10 is a schematic front view showing a configuration of the ink tank according to the third embodiment.
Figure 11:
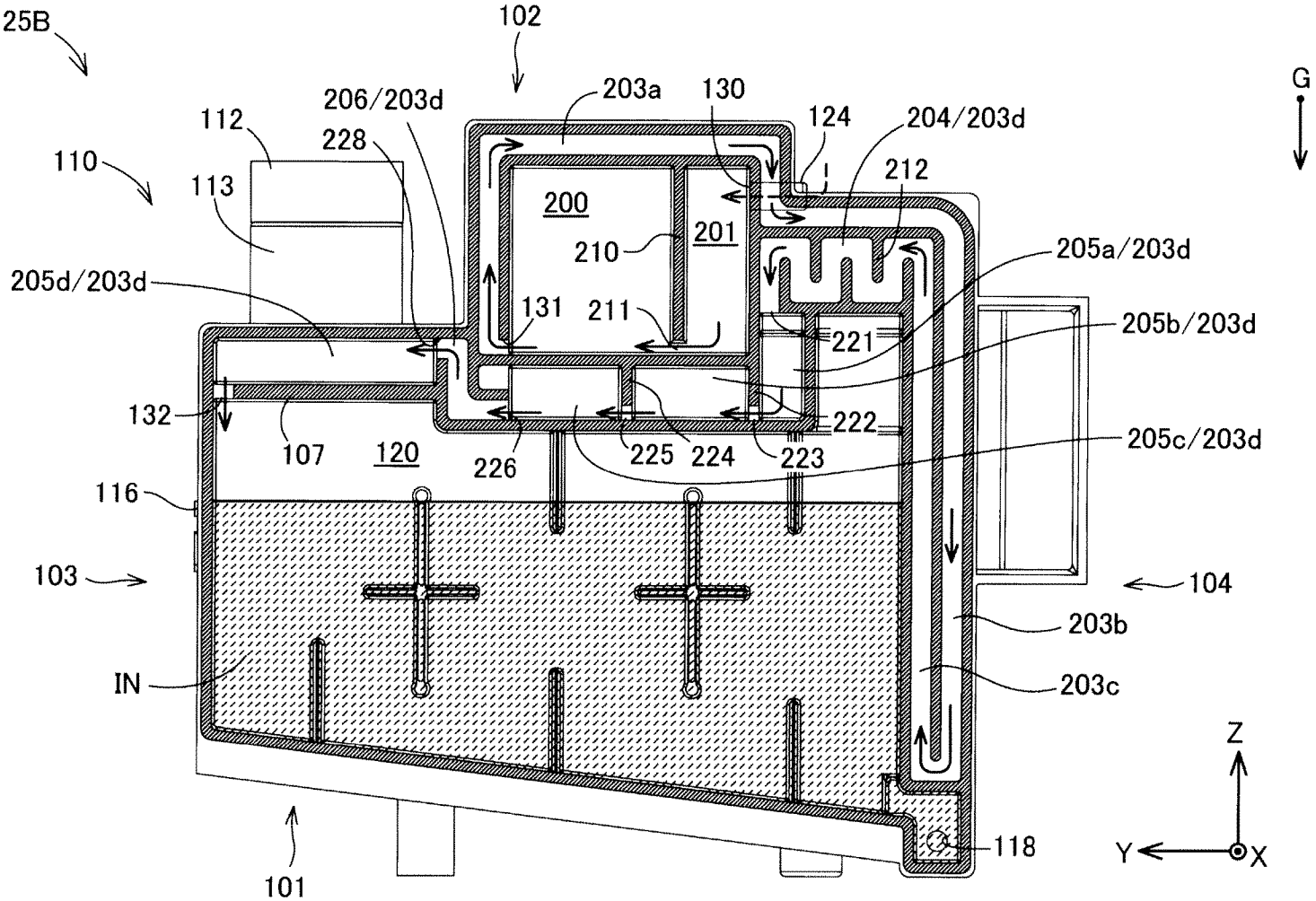
FIG. 11 is a schematic cross-sectional view showing a configuration of the ink tank according to the third embodiment.

A configuration of an ink tank 25B according to a third embodiment of the present invention will be described with reference to FIGS. 9 to 11. FIG. 9 is a schematic exploded perspective view of the ink tank 25B in which the case member 110 and the sheet member 111 are separately shown. FIG. 10 is a schematic front view of the ink tank 25B as viewed in a direction opposite to the direction of the arrow Y. FIG. 11 is a schematic cross-sectional view of the ink tank 25B taken along the line C-C shown in FIG. 10. In the following description and the diagrams that will be referred to, the same constituent elements as those described in the first embodiment or the second embodiment or corresponding constituent elements are given the same reference numerals as those used in the first embodiment or the second embodiment.

As in the ink tank according to the first embodiment, in the ink tank 25B according to the third embodiment, the opening of the case member 110 that is on the sixth surface portion 106 side is sealed through melt adhesion of the sheet member 111 (FIGS. 9 and 10). Inside the ink tank 25B, an ink containing portion 120 and an atmospheric air introducing portion 121B are formed (FIGS. 9 and 11). Inside the ink containing portion 120, a plurality of reinforcing ribs 108 are provided upright parallel to the direction of the arrow X. The reinforcing ribs 108 may be omitted.

The atmospheric air introducing portion 121B includes a first buffer chamber 200, a second buffer chamber 201, and an atmospheric air communication path 203 (FIG. 11). The first buffer chamber 200 is a space corresponding to the buffer chamber 122 of the ink tank 25A according to the second embodiment. It is desirable that the first buffer chamber 200 has a capacity V that satisfies the relationships represented by two inequality expressions (1) and (2) described in the first embodiment. The second buffer chamber 201 is formed in a position adjacent to the first buffer chamber 200 with an inner wall portion 210 interposed therebetween. The first buffer chamber 200 is in communication with the second buffer chamber 201 via a communication inlet 211. The communication inlet 211 is formed as a gap space between the inner wall portion 210 and the sheet member 111 in the lower end of the inner wall portion 210. In the third embodiment, the communication inlet 211 of the first buffer chamber 200 corresponds to a subordinate concept of the second communication inlet according to the present invention.

The depth in the direction of the arrow X and the height in the direction of the arrow Z of the second buffer chamber 201 are substantially the same as those of the first buffer chamber 200. However, the width in the direction of the arrow Y of the second buffer chamber 201 is smaller than that of the first buffer chamber 200. The second buffer chamber 201 has a capacity smaller than that of the first buffer chamber 200. The second buffer chamber 201 is connected to the atmospheric air intake portion 124, and has an opening serving as an atmospheric air intake inlet 130 on an upper wall surface of the second buffer chamber 201. When the atmospheric air communication path 203 is regarded as a first atmospheric air communication path, the atmospheric air intake portion 124 and the second buffer chamber 201 can be seen as constituting a second atmospheric air communication path through which atmospheric air can be introduced into the first buffer chamber 200.

The atmospheric air communication path 203 includes a first path portion 203*a*, a second path portion 203*b*, a third path portion 203*c*, and a fourth path portion 203*d*. The first path portion 203*a* is an atmospheric air flow path formed in a position corresponding to the first path portion 123*a*A of the ink tank 25A according to the second embodiment (FIG. 8). The first path portion 203*a* extends upward from the communication inlet 131 provided in the lower end portion of the first buffer chamber 200. Then, the first path portion 203*a* extends in a direction opposite to the direction of the arrow Y along an upper outer peripheral end portion of the first buffer chamber 200 and the second buffer chamber 201 and a bent flow path portion 204 (described later) of the fourth path portion 203*d*, is bent downward at an end portion that is on the fourth surface portion 104 side, and is connected to the second path portion 203*b*.

The second path portion 203*b* and the third path portion 203*c* are atmospheric air flow paths formed at positions corresponding to the second path portion 123*b* and the third path portion 123*c* of the ink tank 25A according to the second embodiment. The second path portion 203*b* extends from the first path portion 203*a* that is on the fourth surface portion 104 side toward the lower end portion of the ink containing portion 120, and extends to a point short of where the ink supply inlet 118 is formed. The third path portion 203*c* is bent at the lower end portion of the second path portion 203*b* and extends in parallel to the second path portion 203*b* to a position below the first path portion 203*a*.

The fourth path portion 203*d* is formed at a position corresponding to the fourth path portion 123*d* of the ink tank 25A according to the second embodiment, and extends in the direction of the arrow Y on the upper end side of the ink containing portion 120. The fourth path portion 203*d* includes the bent flow path portion 204, four buffer portions 205*a* to 205*d*, and a connecting path portion 206.

The bent flow path portion 204 is a flow path extending in the direction of the arrow Y with the flow path direction having a plurality of turns in the direction of the arrow Z, and is formed in an area connecting to the third path portion 203*c*. In the bent flow path portion 204, a flow path wall 212 that has one end portion connected to an upper wall surface and is parallel in the direction of the arrow Z and a flow path wall 212 that has one end portion connected to a lower wall surface and is parallel to the direction of the arrow Z are alternately disposed in the direction of the arrow Y. With the bent flow path portion 204, it is possible to extend the path length between the ink containing portion 120 and the first buffer chamber 200, and thus a situation is suppressed in which the ink that has flowed from the ink containing portion 120 into the fourth path portion 203*d* reaches the first buffer chamber 200.

The four buffer portions 205*a* to 205*d* are formed as internal spaces having a greater depth in the direction of the arrow X than the other parts of the fourth path portion 203*d*. Among the four buffer portions 205*a* to 205*d*, the first buffer portion 205*a*, the second buffer portion 205*b*, and the third buffer portion 205*c* are disposed adjacent to each other in the direction of the arrow Y.

The first buffer portion 205*a* is connected to the bent flow path portion 204 via a communication inlet 221 formed in an upper end portion thereof. The first buffer portion 205*a* and the second buffer portion 205*b* are connected via a communication inlet 223 formed in a lower end portion of a boundary wall 222 therebetween. The second buffer portion 205*b* and the third buffer portion 205*c* have substantially the same size, and are formed in positions below the first buffer chamber 200 and the second buffer chamber 201. The second buffer portion 205*b* is connected to the third buffer portion 205*c* via a communication inlet 225 formed in a lower end portion of a boundary wall 224 between the second buffer portion 205*b* and the third buffer portion 205*c*. The two communication inlets 223 and 225 are formed between a gap formed in the boundary wall 222 and the sheet member 111 and between a gap formed in the boundary wall 224 and the sheet member 111, respectively.

The third buffer portion 205*c* is connected to the connecting path portion 206 via a communication inlet 226 formed in a lower end portion thereof. The connecting path portion 206 is a cranked flow path, and includes two flow paths extending in the direction of the arrow Y and an intermediate flow path that extends in the up-down direction and connects the two flow paths on a lower side and an upper side thereof. The buffer portions 205*a* to 205*c* function as storage portions for storing ink when the ink tank 25B is in the 180° rotated orientation, a detail of which will be described later.

The fourth buffer portion 205*d* is located at an end portion that is on the third surface portion 103 side, and is connected to the upper flow path of the connecting path portion 206 via a communication inlet 228 formed in an upper end portion thereof. Also, the fourth buffer portion 205*d* is in communication with the ink containing portion 120 via an atmospheric air introducing inlet 132 in its bottom surface.

Here, if, for example, the ink tank 25B is rocked when it is in the reference orientation, the ink contained in the ink containing portion 120 may accidentally flow into the fourth buffer portion 205*d* via the atmospheric air introducing inlet 132. Even in such a case, the fourth buffer portion 205*d* includes, as described above, the communication inlet 228 that is located on the upper end side and is in communication with the connecting path portion 206. Accordingly, a situation is suppressed in which the ink that has flowed into the fourth buffer portion 205*d* from the ink containing portion 120 flows further into an area beyond the fourth buffer portion 205*d*.

Figure 12:
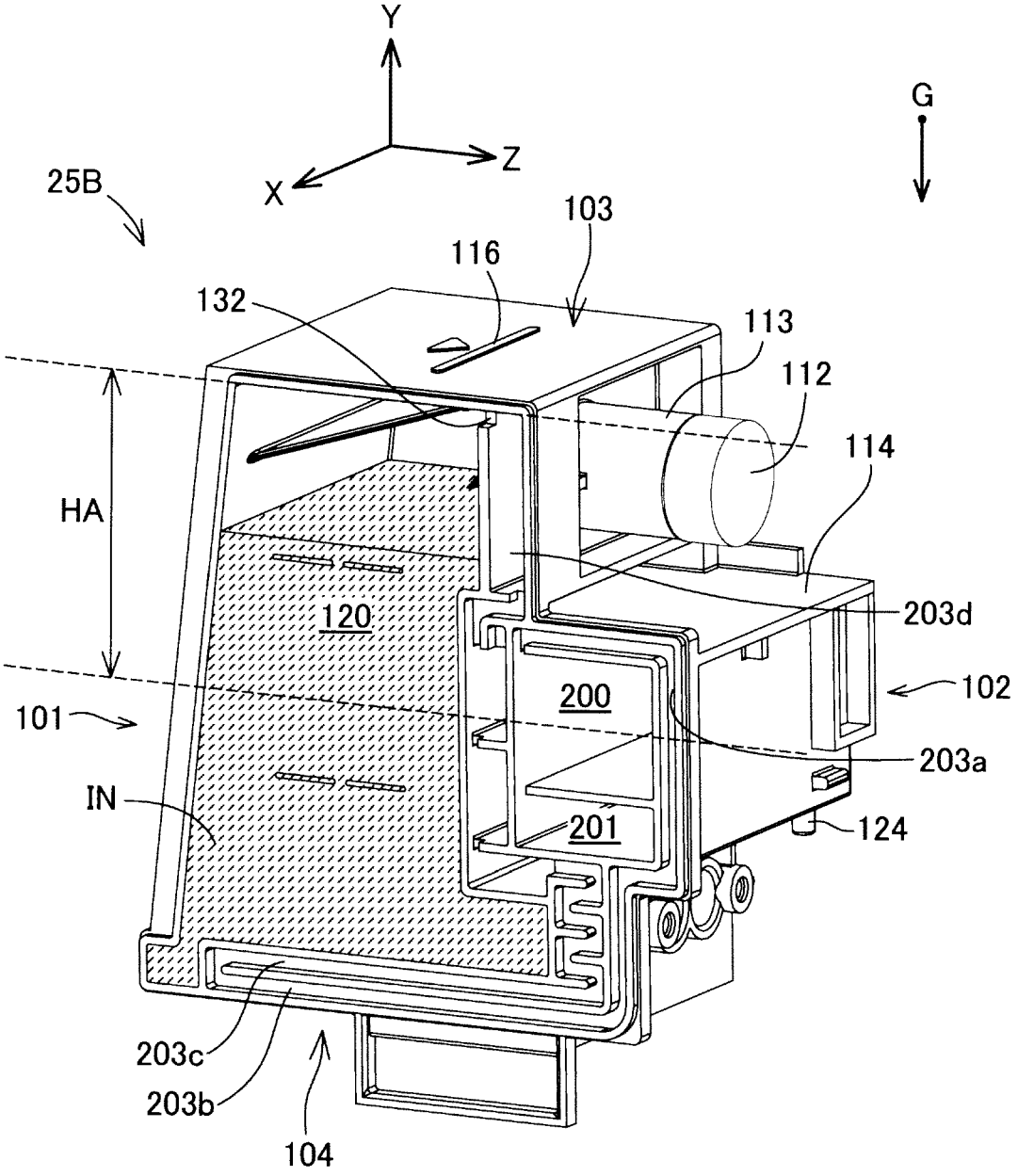
FIG. 12 is a schematic diagram for illustrating a mechanism that suppresses ink leakage.
Figure 13:
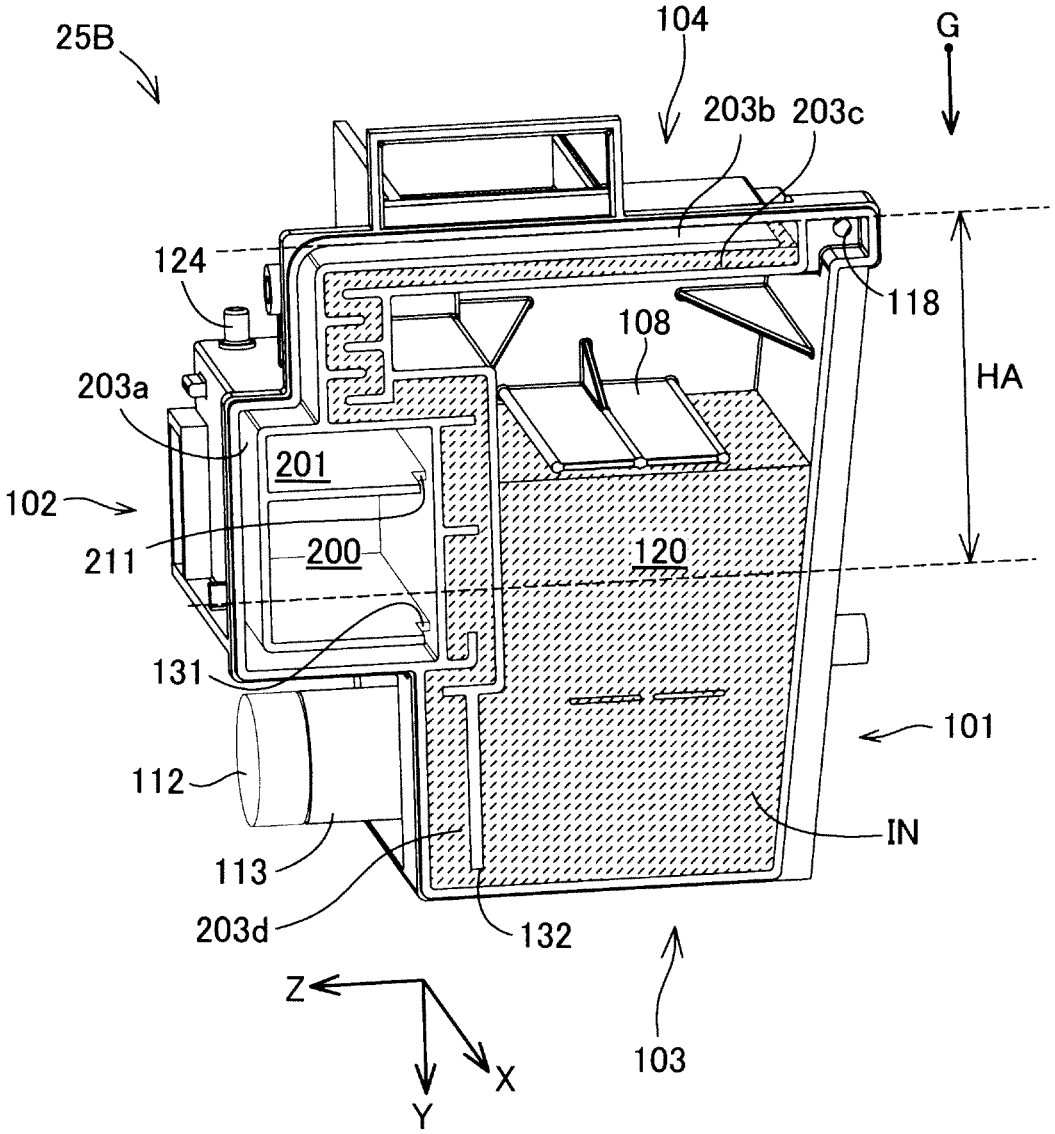
FIG. 13 is a schematic diagram for illustrating a mechanism that suppresses ink leakage.

The mechanism that suppresses ink leakage in the ink tank 25B according to the third embodiment will be described with reference to FIGS. 12 to 14. FIG. 12 shows an internal state of the ink tank 25B when it is in the 90° rotated-left orientation. FIG. 13 shows an internal state of the ink tank 25B when it is in the 90° rotated-left orientation.

Figure 14:
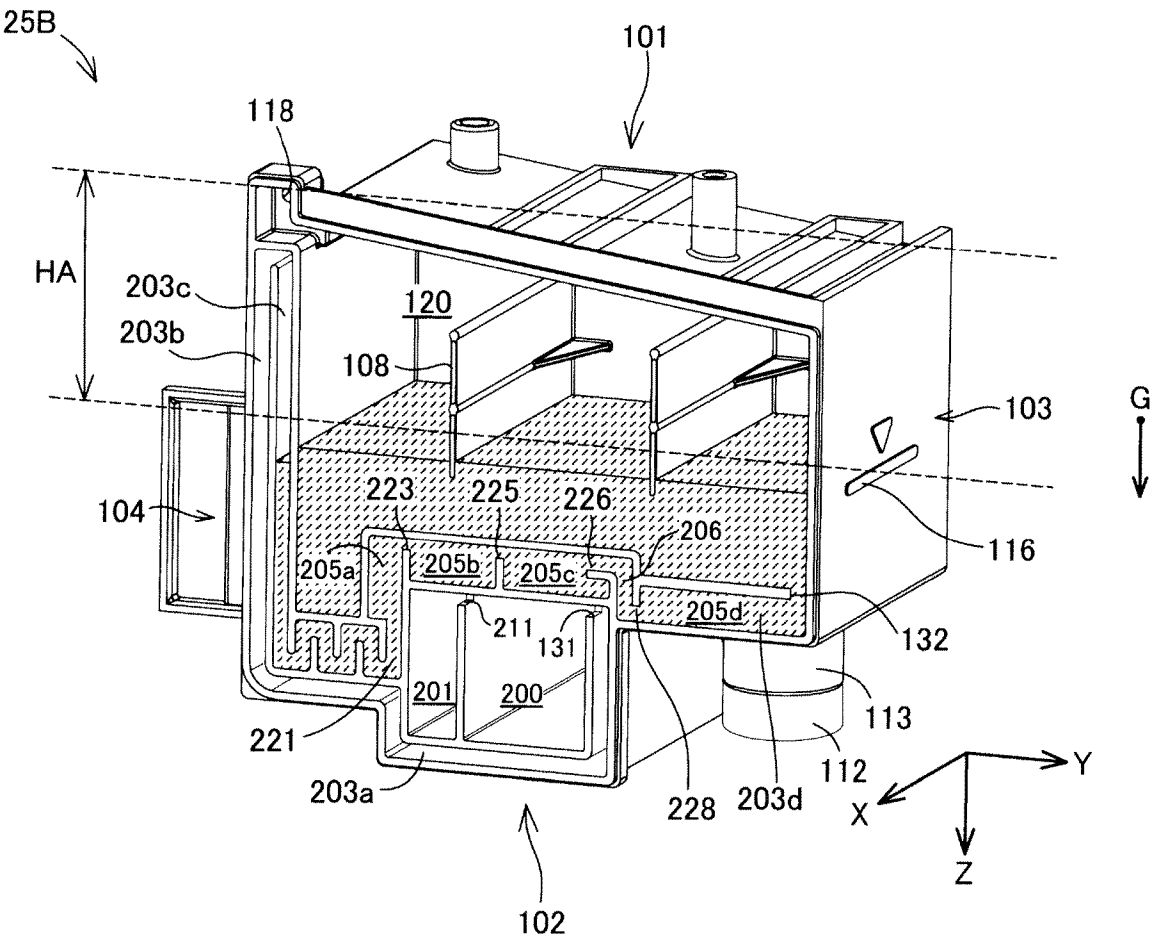
FIG. 14 is a schematic diagram for illustrating a mechanism that suppresses ink leakage.

FIG. 14 shows an internal state of the ink tank 25B when it is in the 180° rotated orientation.

In the ink tank 25B according to the third embodiment, even when it is rotated by 90° or 180° in the first direction or the second direction from the reference orientation, at least a portion of the atmospheric air communication path 123B is located in the upper region HA of the ink containing portion 120 (FIGS. 12 to 14). Accordingly, as in the ink tank 25A according to the second embodiment, the occurrence of ink leakage caused by the orientation of the ink tank 25B being rotated is suppressed.

In the ink tank 25B according to the third embodiment, when it is in an orientation in which the atmospheric air introducing inlet 132 is located on a lower end side of the ink containing portion 120 (FIGS. 13 and 14), the communication inlet 211 of the first buffer chamber 200 is located above the lower end portion of the first buffer chamber 200. Accordingly, as in the ink tank 25A according to the second embodiment, even if the air in the ink containing portion 120 expands, the ink can be stored in the first buffer chamber 200, and thus the occurrence of leakage of the ink to the outside is suppressed.

Also, in the ink tank 25B according to the third embodiment, the second buffer chamber 201 for storing ink is provided adjacent to the first buffer chamber 200, and thus the occurrence of ink leakage is further suppressed. Particularly when the ink tank 25B is in the 90° rotated-left orientation (FIG. 13), the atmospheric air intake inlet 130 connected to the second buffer chamber 201 is upwardly open in the upper end portion of the second buffer chamber 201. Accordingly, the ink can be stored by using the entire space of the second buffer chamber 201, and thus the occurrence of leakage of the ink to the outside is further suppressed.

In addition, in the ink tank 25B according to the third embodiment, when it is in the 180° rotated orientation, the communication inlets 223, 225, and 226 of the three buffer portions 205*a* to 205*c* of the fourth path portion 203*d* are located at the upper end of the fourth path portion 203*d* (FIG. 14). Accordingly, the entire interior of the buffer portions 205*a* to 205*c* can be used as ink storage spaces, and thus the occurrence of ink leakage is further suppressed. At least one of the three buffer portions 205*a* to 205*c* corresponds to a subordinate concept of the intermediate buffer portion according to the present invention, and the communication inlets 223, 225, and 226 correspond to a subordinate concept of the first opening or the second opening.

As described above, with the ink tank 25B according to the third embodiment, a situation is suppressed in which the ink leaks to the outside when the ink tank 25B is rotated from the reference orientation and brought into another orientation. In addition, the ink tank 25B according to the third embodiment can provide the same advantageous effects as the ink tank 25 according to the first embodiment and the ink tank 25A according to the second embodiment.

D. Fourth Embodiment

Figure 15:
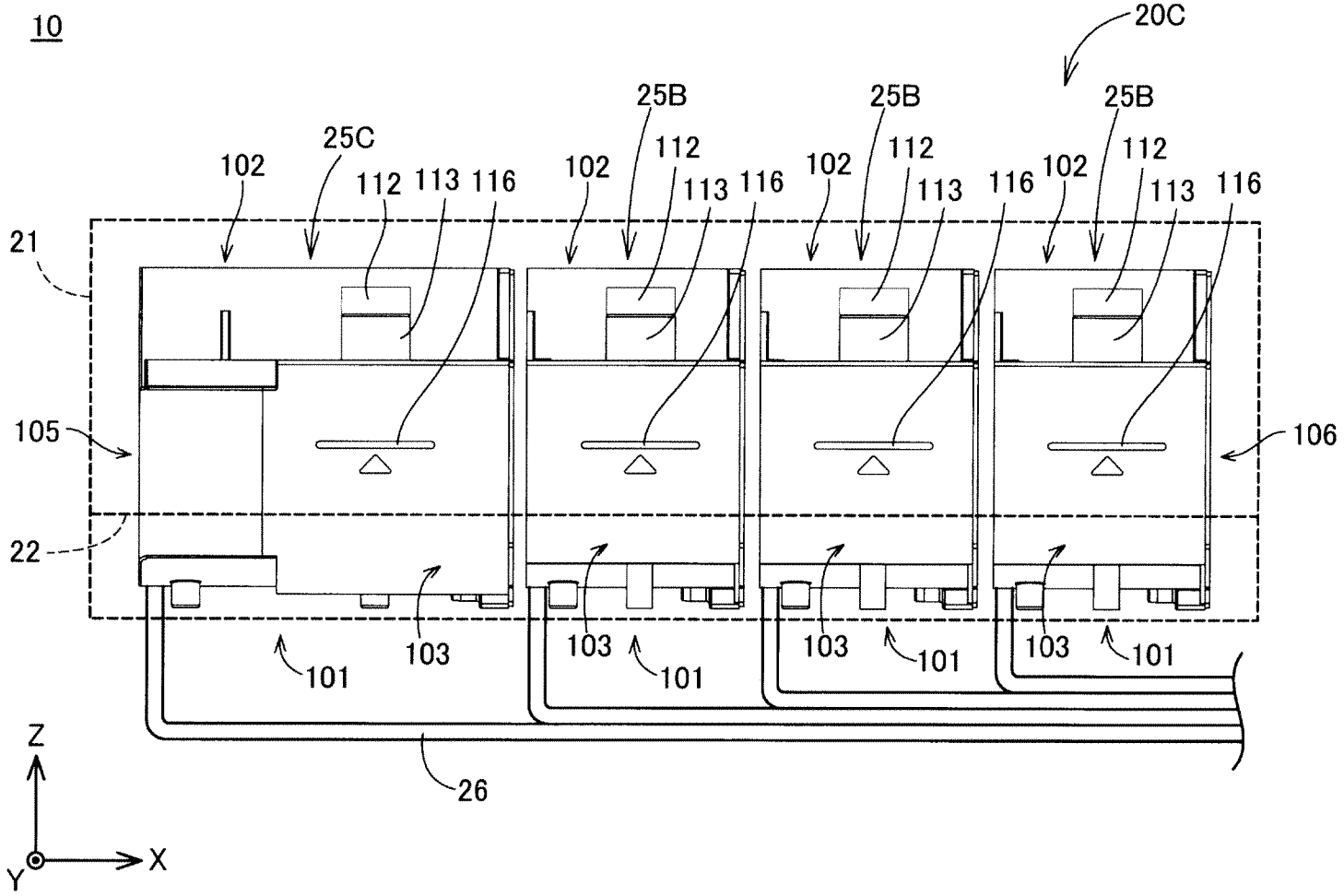
FIG. 15 is a schematic diagram showing a configuration of a tank unit included in a printer according to a fourth embodiment.

FIG. 15 is a schematic diagram showing a configuration of a tank unit 20C included in a printer 10C according to a fourth embodiment of the present invention. The printer 10C according to the fourth embodiment has substantially the same configuration as that of the printer 10 according to the first embodiment, except that a tank unit 20C is included instead of the tank unit 20. The tank unit 20C includes three first ink tanks 25B and one second ink tank 25C. The ink tanks 25B and 25C are linearly aligned in the direction of the arrow X such that their third surface portions 103 are flush with each other, and in this state they are detachably housed in an internal space 21*s* of a casing portion 21 (indicated by a broken line).

The first ink tanks 25B have substantially the same configuration as that of the ink tank 25B according to the third embodiment, and thus a description thereof is omitted here. The second ink tank 25C has a capacity different from the ink capacity of the first ink tanks 25B, and is capable of containing a larger amount of ink than the first ink tanks 25B, which will be described later. In the printer 10C, for example, black ink, which is consumed in a large amount, is allocated to the second ink tank 25C, and other color inks such as cyan, magenta, and yellow are allocated to the first ink tanks 25B.

Figure 16:
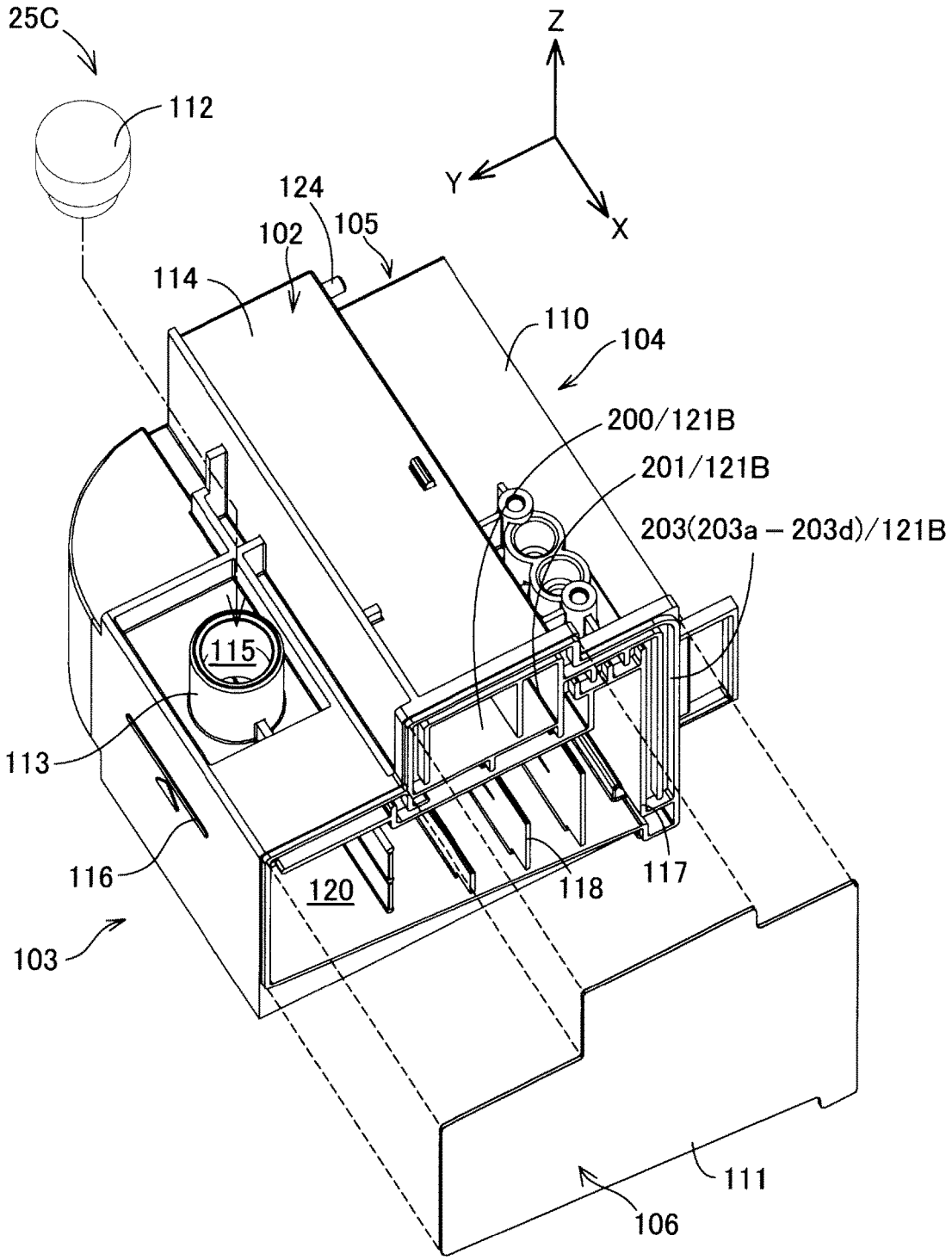
FIG. 16 is a schematic exploded perspective view of a second ink tank.
Figure 17:
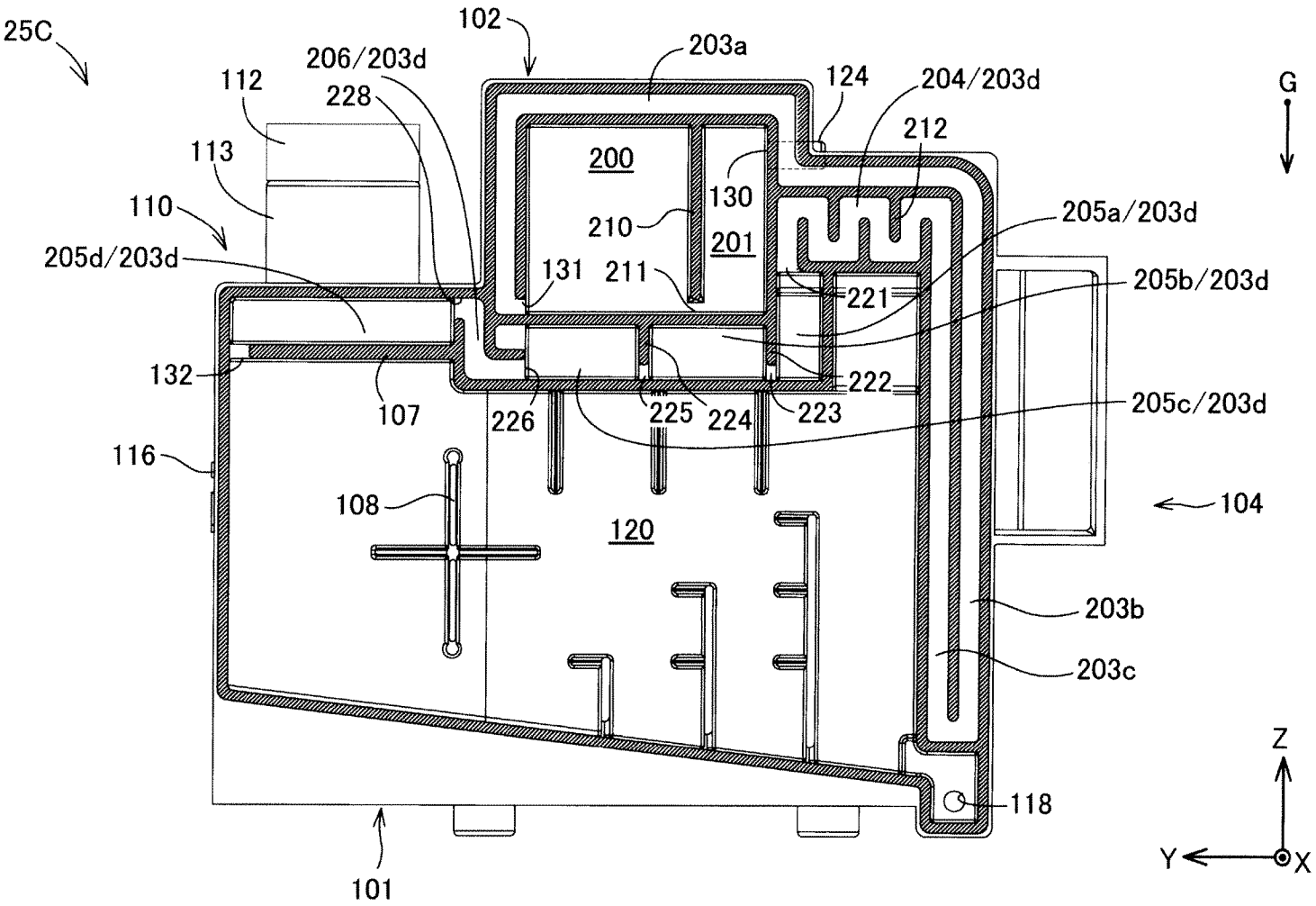
FIG. 17 is a schematic diagram showing an internal configuration of the second ink tank.

A configuration of the second ink tank 25C will be described with reference to FIGS. 16 and 17, in addition to FIG. 15. FIG. 16 is a schematic exploded perspective view of the second ink tank 25C. FIG. 17 is a schematic diagram showing an internal configuration of the second ink tank 25C. FIG. 17 shows the inside of a case member 110 as viewed in a direction opposite to the direction of the arrow X. In the following description and the diagrams that will be referred to, the same constituent elements as those described in the third embodiment or corresponding constituent elements are given the same reference numerals as those used in the third embodiment.

The second ink tank 25C has a greater width in the direction of the arrow X than that of the first ink tanks 25B (FIG. 15). Accordingly, in the second ink tank 25C, an ink containing portion 120 and two buffer chambers 200 and 201 have capacities larger than those of the first ink tanks 25B. Thus, the second ink tank 25C has an ink capacity larger than that of the first ink tanks 25B. An atmospheric air introducing portion 121C of the second ink tank 25C has substantially the same configuration as that of the first ink tanks 25B (FIGS. 16 and 17). The configuration of the second ink tank 25C other than the above is substantially the same as that of the first ink tanks 25B.

As described above, in the printer 10C according to the fourth embodiment, the tank unit 20C includes a first ink tank 25B and a second ink tank 25C that have different sizes. For this reason, it is possible to install a plurality of types of ink according to the pattern of consumption of the inks in the printing portion 30. Accordingly, the adaptability for the characteristics of the printing portion 30 is enhanced, and user convenience is enhanced. Also, the ink tanks 25B and 25C included in the printer 10C according to the fourth embodiment can provide the same advantageous effects as those described in the third embodiment such as suppressing ink leakage.

E. Fifth Embodiment

Figure 18:
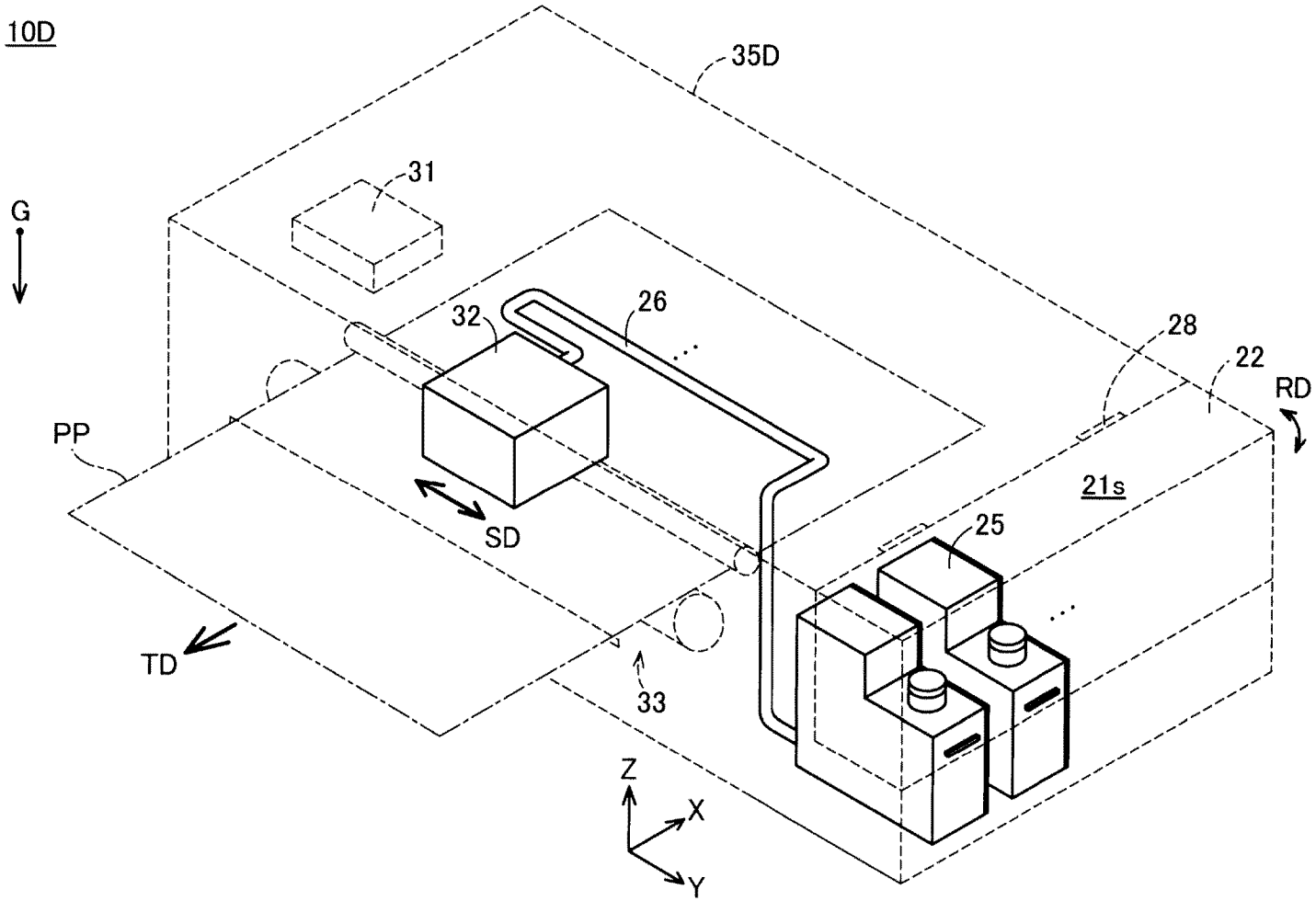
FIG. 18 is a schematic diagram showing a configuration of a printer according to a fifth embodiment.

FIG. 18 is a schematic diagram showing a configuration of a printer 10D according to a fifth embodiment of the present invention. The printer 10D according to the fifth embodiment has substantially the same configuration as that of the printer 10 according to the first embodiment, except that a plurality of ink tanks 25 are housed in a casing portion 35D (indicated by a broken line) of the printer 10D together with a printing portion 30. The casing portion 35D of the printer 10D is provided with a cover portion 22 that is similar to that provided in the casing portion 21 of the tank unit 20 according to the first embodiment (FIG. 1) so that the user can access the ink tanks 25.

With the printer 10D according to the fifth embodiment, because the ink tanks 25 are integrally housed in the main body, the installation efficiency of the printer 10D is enhanced. Also, the ink tanks 25 included in the printer 10D according to the fifth embodiment can provide the same advantageous effects as those described in the first embodiment such as suppressing ink leakage. In the printer 10D according to the fifth embodiment, instead of the ink tank 25, it is possible to use the ink tank 25A according to the second embodiment, the ink tank 25B according to the third embodiment, or the two types of ink tanks 25B and 25C.

F. Variations

F1. Variation 1

The flow path configurations of the atmospheric air communication paths 123, 123A, and 203 described in the embodiments given above are merely examples, and thus the flow path configuration is not limited to those described in the embodiments given above. The atmospheric air communication paths 123, 123A, and 203 may have a different flow path configuration. The atmospheric air communication path 123 of the ink tank 25 according to the first embodiment described above has a flow path configuration that includes four path portions 123*a* to 123*d*. However, the atmospheric air communication path 123 may include a path portion other than the four path portions 123*a* to 123*d*. For example, the atmospheric air communication path 123 may include an additional return path portion that extends in the direction of the arrow Z between the third path portion 123*c* and the fourth path portion 123*d*, or may include an additional path portion that extends in the direction of the arrow X in the second path portion 123*b*, the third path portion 123*c*, or at some midpoint of the fourth path portion 123*d*. Also, in the atmospheric air communication path 123 according to the first embodiment, the second path portion 123*b* and the third path portion 123*c* extend between the first surface portion 101 and the second surface portion 102, and the fourth path portion 123*d* extends between the third surface portion 103 and the fourth surface portion 104. However, the second path portion 123*b* and the third path portion 123*c* may be configured to extend to some midpoint between the first surface portion 101 and the second surface portion 102, and the fourth path portion 123*d* may be configured to extend to some midpoint between the third surface portion 103 and the fourth surface portion 104. The same applies to the other embodiments. In the atmospheric air communication paths 203 of the ink tanks 25B and 25C according to the third embodiment and the fourth embodiment, the bent flow path portion 204 and the buffer portions 205*a* to 205*d* may be omitted. The atmospheric air communication paths 123, 123A, and 203 of the embodiments given above only need to be configured such that at least a portion of the atmospheric air communication paths 123, 123A, and 203 is located in the upper region HA when the ink tank is at least in the reference orientation, either of the 90° rotated-right orientation or the 90° rotated-left orientation, and the 180° rotated orientation.

F2. Variation 2

In the embodiments given above, the ink tanks 25, 25A, 25B and 25C are configured to include a case member 110 and a sheet member 111. However, the ink tanks 25, 25A, 25B, and 25C need not be configured to include a case member 110 and a sheet member 111. The ink tanks 25, 25A, 25B, and 25C may be entirely configured with, for example, a resin member such as a plastic member. Alternatively, the ink tanks 25, 25A, 25B, and 25C may be configured with a combination of a container that constitutes the ink containing portion 120, a container that constitutes the buffer chamber 122, and a tube member that constitutes the atmospheric air communication path 123 that connects these containers.

F3. Variation 3

With the ink tanks 25, 25A, 25B, and 25C of the embodiments given above, when the ink tank is in an orientation in which the atmospheric air introducing inlet 132 is located on the lower end side closer to the lower end portion of the ink containing portion 120 rather than the upper end portion, the atmospheric air intake inlet 130 of the buffer chamber 122 or the communication inlet 211 of the buffer chamber 200 is located in the upper end portion of the buffer chamber 122 or 200. However, the atmospheric air intake inlet 130 or the communication inlet 211 need not be located in the upper end portion of the buffer chamber 122 or 200 when the ink tank 25, 25A, 25B and 25C are in the above-described orientation. It is only necessary that the atmospheric air intake inlet 130 or the communication inlet 211 is located above the lower end portion of the buffer chamber 122 or 200.

F4. Variation 4

In the ink tanks 25, 25A, 25B, and 25C of the embodiments given above, the communication inlet 131 is formed at an end portion of the buffer chamber 122 or 200 in the direction of the arrow Y. However, the communication inlet 131 only need to be connected to the atmospheric air communication path 123, 123A or 123B, and the communication inlet 131 may be formed in a different position. For example, the communication inlet 131 may be formed in a position between two end portions in the direction of the arrow Y.

F5. Variation 5

The reference orientation of the ink tanks 25, 25A, 25B, and 25C according to the embodiments given above is an orientation in which the ink tanks 25, 25A, 25B, and 25C are in use, and in which the first surface portion 101 faces toward the bottom surface. The reference orientation of the ink tanks 25, 25A, 25B and 25C need not be the orientation in which the first surface portion 101 faces toward the bottom surface. It is only necessary that the reference orientation of the ink tanks 25, 25A, 25B, and 25C is an orientation in which the ink tanks 25, 25A, 25B, and 25C are in use, to be specific, an orientation in which at least ink is injected to the ink containing portion 120 via the ink injection portion 113. That is, for example, in the case where ink is loaded from the ink injection portion 113 when the ink tank is in an orientation in which the third surface portion 103 faces downward in the direction of gravity, this orientation is defined as the reference orientation, and corresponds to a subordinate concept of the first orientation according to the present invention.

F6. Variation 6

The atmospheric air communication paths 123, 123A, and 203 of the embodiments given above are configured as grooves that are open on the sixth surface portion 106 side. However, the atmospheric air communication paths 123, 123A, and 203 of the embodiments given above need not be configured as the grooves of the case member 110, and may be configured as, for example, tunnel-shaped flow paths passing through a wall portion constituting the case member 110.

F7. Variation 7

The ink tanks 25, 25A, 25B, and 25C of the embodiments given above are housed in the casing portion 21 of the tank unit 20 or 20C, or in the casing portion 31D of the printer 10D. However, the ink tanks 25, 25A, 25B, and 25C of the embodiments given above may, instead of being housed in the casing portion 21 or 31D, be connected to the print head portion 32 via the tube 26, with the entire ink tank being exposed to the outside or being held by a cage-like holding member or the like.

F8. Variation 8

In the embodiments given above, the ink tanks 25, 25A, 25B, and 25C contain an ink to be supplied to the print head portion 32 of the printer 10 or 10C. However, the configuration of the ink tanks 25, 25A, 25B, and 25C of the embodiments given above may be applied to a tank that contains a liquid to be supplied to a liquid ejection system other than a printer. For example, the configuration may be applied to a cleaning agent tank for supplying a cleaning agent in the form of a liquid to a cleaning agent ejection apparatus that ejects the cleaning agent.

The present invention is not limited to the embodiments, examples and variations described above, and can be implemented with various configurations within a scope that does not depart from the spirit and scope of the present invention. For example, the technical features in the embodiments, examples and variations that correspond to the technical features in respective implementations described in Summary of Invention can be replaced or combined as appropriate in order to solve some or all of the above-described problems or achieve some or all of the above-described effects. Also, a technical feature that is not described as essential in the specification may be omitted as appropriate.

REFERENCE SIGNS LIST

10, 10C, 10D . . . printer
20, 20C . . . tank unit
21 . . . casing portion
21*s* . . . internal space
22 . . . cover portion
25, 25A, 25B, 25C . . . ink tank
26 . . . tube
30 . . . printing portion
31 . . . control portion
32 . . . print head portion
33 . . . conveyance mechanism
35, 35D . . . casing portion
101 to 106 . . . surface portion
107 . . . inner wall portion
108 . . . reinforcing rib
110 . . . case member
111 . . . sheet member
112 . . . cap member
113 . . . ink injection portion
114 . . . buffer chamber housing portion
115 . . . opening
116 . . . mark portion
117 . . . ink supply portion
117*h* . . . cylindrical hole
118 . . . ink supply inlet
120 . . . ink containing portion
121, 121A, 121B . . . atmospheric air introducing portion
122 . . . buffer chamber
123, 123A, 123B . . . atmospheric air communication path
123*a* to 123*d*, 123*a*A . . . path portion
124 . . . atmospheric air intake portion
124*h* . . . cylindrical hole
125 . . . ink injection inlet
130 . . . atmospheric air intake inlet
131 . . . communication inlet
132 . . . atmospheric air introducing inlet
200 . . . first buffer chamber
201 . . . second buffer chamber
203 . . . atmospheric air communication path
203*a* to 203*d* . . . path portion
204 . . . bent flow path portion
205*a* to 205*d* . . . buffer portion
221, 223, 225, 226, 228 . . . communication inlet
222, 224 . . . boundary wall

The invention claimed is:

1. A tank capable of supplying a liquid to a liquid ejection head, the tank comprising:

a liquid containing portion that is capable of containing the liquid;

a liquid injection portion through which the liquid can be injected into the liquid containing portion; and an atmospheric air introducing portion through which atmospheric air can be introduced into the liquid containing portion, wherein the atmospheric air introducing portion includes a buffer chamber that is capable of containing atmospheric air and an atmospheric air communication path that communicates between the buffer chamber and the liquid containing portion, the atmospheric air communication path includes an atmospheric air introducing inlet in an area where the atmospheric air communication path intersects with the liquid containing portion, the buffer chamber is provided with a first communication inlet that is connected to the atmospheric air communication path and a second communication inlet through which external atmospheric air can be introduced into the buffer chamber, the second communication inlet is disposed at a location where the buffer chamber and an atmospheric air intake portion connected to the buffer chamber intersect, when the tank is in a first orientation in which the liquid is injected into the liquid containing portion via the liquid injection portion, the atmospheric air introducing inlet is located on an upper end side of the liquid containing portion, the atmospheric air communication path has:

(i) a first portion that is located at a height position between an upper end portion of the liquid containing portion and a midpoint between the upper end portion of the liquid containing portion and a lower end portion of the liquid containing portion when the tank is in the first orientation;

(ii) a second portion that is located at a height position between the upper end portion of the liquid containing portion and a midpoint between the upper end portion of the liquid containing portion and a lower end portion of the liquid containing portion when the tank is in a second orientation in which the tank has been rotated by 90° in a predetermined direction from the first orientation; and (iii) a third portion that is located at a height position between the upper end portion of the liquid containing portion and a midpoint between the upper end portion of the liquid containing portion and a lower end portion of the liquid containing portion when the tank is in a third orientation in which the tank has been rotated by 180° in the predetermined direction from the first orientation, and the second communication inlet is located above a lower end portion of the buffer chamber when the tank is in the second orientation and in which the atmospheric air introducing inlet is located on a lower end side, and when the tank is in the third orientation.

2. The tank according to claim 1, wherein the atmospheric air communication path includes a first path portion, a second path portion, a third path portion, and a fourth path portion, and when the tank is in the first orientation, the first path portion extends on an upper side or a lower side of the buffer chamber, the second path portion extends downward from the first path portion, the third path portion extends upward from a lower end of the second path portion, and the fourth path portion extends in a direction that intersects with an up-down direction of the tank from an upper end of the third path portion on the upper end side of the liquid containing portion.

3. The tank according to claim 1, comprising a reference amount specifying portion that specifies an amount of the liquid contained in the liquid containing portion to a predetermined reference amount, wherein a relationship represented by the following expression is satisfied:

$$Va\times\alpha-Vb<V<Va\times\alpha,$$

where V represents a capacity of the buffer chamber, Va represents a difference between a capacity of the liquid containing portion and a volume of the liquid in the reference amount at room temperature, Vb represents a capacity of the atmospheric air communication path, and $\alpha$ is a predetermined coefficient of 1 or less.

4. The tank according to claim 3, wherein the predetermined coefficient $\alpha$ is a value in which an air expansion coefficient is reflected.

5. The tank according to claim 1, wherein the atmospheric air communication path includes an intermediate buffer portion, the intermediate buffer portion includes a first opening that is in communication with the liquid containing portion side and a second opening that is in communication with the buffer chamber side, and when the tank is in the third orientation, the first opening and the second opening are located above a lower end of the intermediate buffer portion.

6. The tank according to claim 1, wherein the atmospheric air communication path is a first atmospheric air communication path, and the tank includes a second atmospheric air communication path that is connected to the second communication inlet.

7. The tank according to claim 6, wherein the buffer chamber is a first buffer chamber, and the second atmospheric air communication path includes a second buffer chamber that is capable of containing atmospheric air to be introduced into the first buffer chamber.

8. The tank according to claim 1, wherein the first orientation is an orientation in which the liquid is supplied from the tank to the liquid ejection head, and when the tank is in the first orientation, the first communication inlet is located in a lower end of the buffer chamber.

9. The tank according to claim 1, comprising:

a case member that is a box having an opening in one direction; and a sheet member that is bonded so as to be capable of sealing the opening of the case member, wherein the liquid containing portion and the atmospheric air introducing portion are formed between the case member and the sheet member, and each of the first orientation, the second orientation, and the third orientation is an orientation in which a direction of the opening of the case member is perpendicular to a vertical direction.

10. A tank unit, comprising:

a first tank and a second tank that are the tanks according to claim 9; and an outer jacket that is capable of housing the first tank and the second tank, wherein the first tank and the second tank have different widths in the direction of the opening of the case member such that the liquid containing portions of the first tank and the second tank have different capacities.

11. A tank unit, comprising:

the tank according to claim 1; and an outer jacket that houses the tank.

12. A liquid ejection system, comprising:

the tank unit according to claim 11; and a liquid ejection apparatus that includes the liquid ejection head and to which the tank unit is connected.

13. A liquid ejection system, comprising:

the tank according to claim 1;

a liquid ejection head; and an outer jacket that is capable of housing the tank and the liquid ejection head.

14. The tank according to claim 1, wherein the buffer chamber includes a first buffer chamber and a second buffer chamber, and wherein the second communication inlet is located at an upper end portion of the second buffer chamber.

15. The tank according to claim 14, wherein the first buffer chamber has a greater capacity than the second buffer chamber.

16. The tank according to claim 1, wherein when the tank is in the second orientation, the second communication inlet is upwardly open in an upper end portion of the buffer chamber.

* * * * *